US012672724B2

(12) United States Patent
Toratani

(10) Patent No.: US 12,672,724 B2
(45) Date of Patent: Jul. 7, 2026

(54) MAT

(71) Applicant: TORATANI CO., LTD., Ishikawa (JP)

(72) Inventor: Ikuo Toratani, Ishikawa (JP)

(73) Assignee: TORATANI CO., LTD., Ishikawa (JP)

( * ) Notice: Subject to any disclaimer, the term of this patent is extended or adjusted under 35 U.S.C. 154(b) by 99 days.

(21) Appl. No.: 18/699,700

(22) PCT Filed: Apr. 27, 2022

(86) PCT No.: PCT/JP2022/019094
§ 371 (c)(1),
(2) Date: Apr. 9, 2024

(87) PCT Pub. No.: WO2023/074023
PCT Pub. Date: May 4, 2023

(65) Prior Publication Data

US 2024/0407560 A1 Dec. 12, 2024

(30) Foreign Application Priority Data

Oct. 28, 2021 (WO) ..... PCT/JP2021/039756

(51) Int. Cl.
*A47C 27/00* (2006.01)

(52) U.S. Cl.
CPC ..... *A47C 27/00* (2013.01)

(58) Field of Classification Search
CPC ..... A61G 7/05; A61G 13/10; A61G 13/12; A61G 13/123; A61G 7/07; A47C 27/148; A47C 27/14; A47C 27/146; A47C 27/00
See application file for complete search history.

(56) References Cited

U.S. PATENT DOCUMENTS 3,146,469 A * 9/1964 Slade ..... A47C 27/15 5/699
3,626,526 A * 12/1971 Viel ..... A47C 27/148 5/722

(Continued)

FOREIGN PATENT DOCUMENTS

JP 1-61163 4/1989
JP 6-58762 8/1994

(Continued)

OTHER PUBLICATIONS

International Search Report issued Jul. 12, 2022 in International (PCT) Application No. PCT/JP2022/019094.

*Primary Examiner* — Fredrick C Conley
(74) *Attorney, Agent, or Firm* — Wenderoth, Lind & Ponack, L.L.P.

(57) ABSTRACT

A mattress is designed to facilitate breathing in a supine position. The mattress includes: two serratus posterior superior corresponding parts disposed below a region corresponding to a middle part between origin and insertion of each of left and right serratus posterior superior muscles of a human in a supine position; two scapula supporting sections; and a sixth thoracic vertebra corresponding part disposed below a region corresponding to an area including a sixth thoracic vertebra of a spine. The serratus posterior superior corresponding parts and the scapula supporting sections are configured such that body pressure from the serratus posterior superior corresponding parts is lower than body pressure from the scapula supporting sections. The sixth thoracic vertebra corresponding part is configured such that body pressure from the sixth thoracic vertebra corresponding part is lower than body pressure from a portion supporting a spine other than the sixth thoracic vertebra corresponding part.

19 Claims, 12 Drawing Sheets

(56) References Cited

U.S. PATENT DOCUMENTS

| | | | | |
|---|---|---|---|---|
| 3,742,528 | A * | 7/1973 | Munch | A47C 27/20 5/651 |
| 10,881,218 | B2 * | 1/2021 | Mascull | A61G 5/1048 |
| 2010/0223732 | A1 * | 9/2010 | Allman | A47C 27/148 428/317.1 |
| 2015/0082550 | A1 | 3/2015 | Hui | |
| 2021/0120957 | A1 * | 4/2021 | Amiri | B68G 13/00 |

FOREIGN PATENT DOCUMENTS

| | | | | |
|---|---|---|---|---|
| JP | 2000-23795 | | 1/2000 | |
| JP | 2002-119382 | | 4/2002 | |
| JP | 2007-136049 | | 6/2007 | |
| JP | 2015-2937 | | 1/2015 | |
| JP | 2016-506797 | | 3/2016 | |
| JP | 2018-86434 | | 6/2018 | |
| WO | WO-2020109306 | A1 * | 6/2020 | A47C 27/146 |

* cited by examiner

MAT

TECHNICAL FIELD

The present invention relates to a mattress, and particularly relates to a mattress designed to facilitate breathing in a supine position.

BACKGROUND ART

Some mattresses are used to support bodies of humans who are lying down. Such a mattress is required to make a human lying on the mattress feel comfortable to sleep thereon.

Comfort of a mattress depends on a balance between repulsive force of the mattress and body pressure of a human lying on the mattress. Body pressure is a pressure that the human lying on the mattress is applying to the mattress, and distribution of levels of the pressure differs depending on a body posture of the human. In a supine position, for example, the body pressure is highest at the buttocks followed by the back. If the whole body of a human in a supine position is supported by a mattress and the mattress has uniformly high repulsive force, the body pressure is concentrated on the buttocks and the back of the human and thus the buttocks and the back are likely to be congested. As a result, the human frequently turns in bed to alleviate the congestion and is likely to have a light sleep. Contrariwise, if the mattress has uniformly low repulsive force, the buttocks will sink farthest into the mattress. As a result, the human's backbone in the supine position gets warped greatly from an S-curve shape in an upright position, causing a backache or a stoop.

There are known mattresses whose levels of repulsive force or surface shapes vary from place to place in a direction of the backbone of humans lying supine on the mattresses to make the humans feel comfortable to sleep thereon (for example, see Patent Literatures 1 to 3). On these mattresses, areas coming into contact with the buttocks and the backs of the humans are softer or lower than the other areas. This helps to disperse the body pressure concentrated on the buttocks and the backs to other regions, and as a result, cause the body pressure to get substantially uniformly distributed across the mattresses. This allows the humans' backbone in the supine position to have a substantially S-curve shape in an upright position.

Comfort given by a mattress is associated with breathing depth in addition to a number of times the human turns in bed and the shape of the human's backbone. Deeper breathing during sleep makes the human feel more comfortable to sleep in. However, even when the body pressure gets substantially uniformly distributed across the mattress as described above, the human in the supine position breathes in and out shallowly in some cases, and there is room for improvement in the facilitation of breathing.

CITATION LIST

Patent Literatures

Patent Literature 1: JP H06-058762 U
Patent Literature 2: JP 2002-119382 A
Patent Literature 3: JP 2016-506797 A

SUMMARY OF INVENTION

In view of the above background, it is an object of the present invention to provide a mattress designed to facilitate breathing in a supine position.

A mattress according to the present invention includes a back supporting section that has a reference surface to support a back of a human in a supine position. The back supporting section includes: a pair of serratus posterior superior corresponding parts that are each disposed below a region corresponding to at least a middle part between origin and insertion of each of a pair of left and right serratus posterior superior muscles of the human in the supine position; a pair of scapula supporting sections disposed outside the pair of the serratus posterior superior corresponding parts in a width direction of a body of the human to support regions corresponding to a pair of left and right scapulae of the human in the supine position; and a sixth thoracic vertebra corresponding part disposed below a region corresponding to an area of two or more consecutive thoracic vertebrae including at least a sixth thoracic vertebra of a spine at the back of the human in the supine position. The serratus posterior superior corresponding parts and the scapula supporting sections are configured such that body pressure from the serratus posterior superior corresponding parts is lower than body pressure from the scapula supporting sections. The sixth thoracic vertebra corresponding part is configured such that body pressure from the sixth thoracic vertebra corresponding part is lower than body pressure from a portion of the back supporting section supporting the spine other than the sixth thoracic vertebra corresponding part.

DESCRIPTION OF EMBODIMENTS

Figure 1:
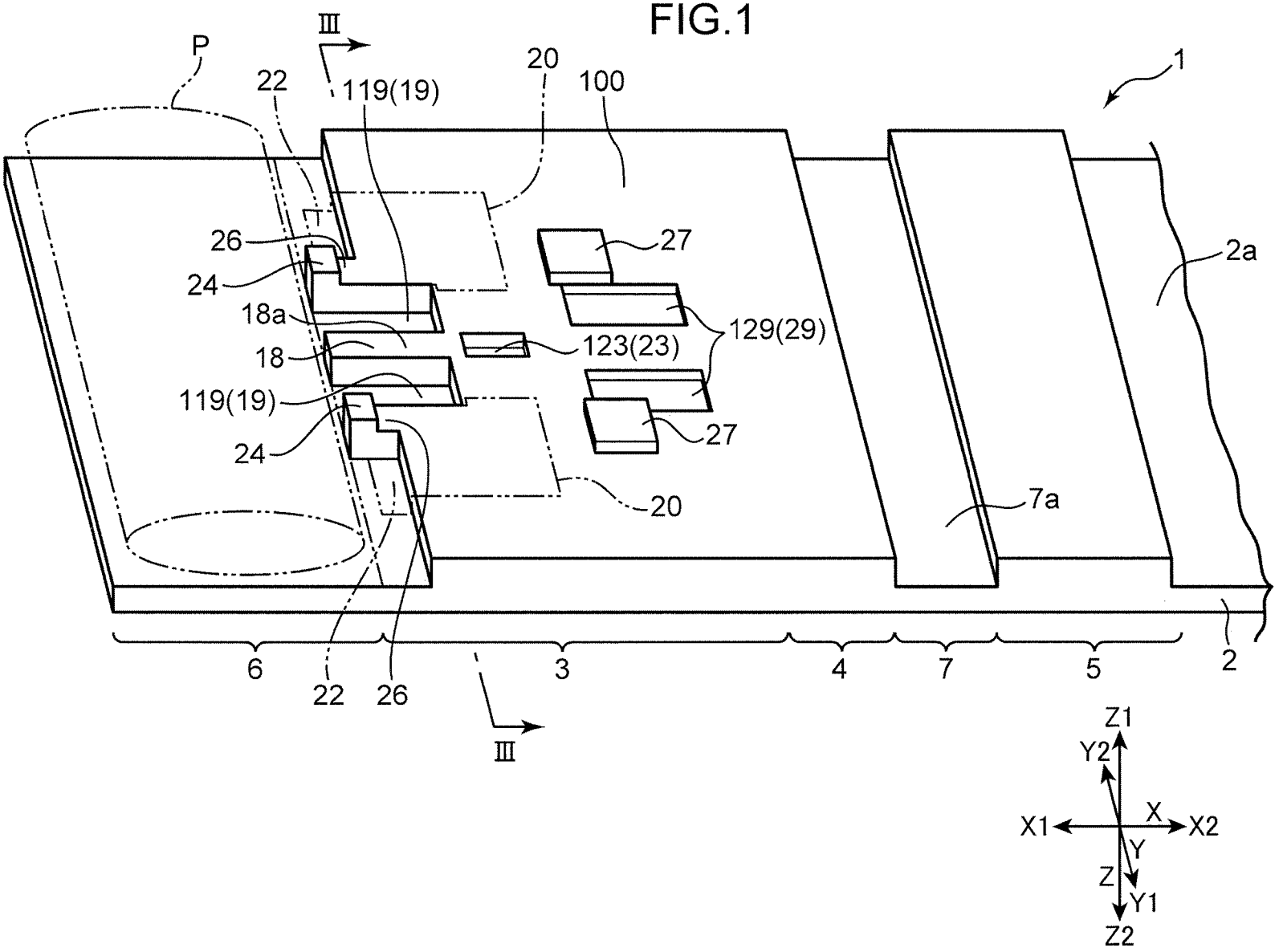
FIG. 1 is a perspective view showing an overall configuration of a mattress according to an embodiment of the present invention.

Hereinafter, a preferred embodiment of the present invention will be described in detail with reference to the attached drawings.

(Description of Outline of Mattress 1)

A mattress 1 shown in FIGS. 1 to 5 is formed as one from a material having elasticity, such as polyurethane having a thin rectangular parallelepiped shape. The mattress 1 together with a frame or a base (not shown) that supports the mattress 1 constitute a bed. A size of the mattress 1 is, for example, such that an entire upper surface of the mattress is able to support a whole body of a human 50 (see FIGS. 4 to 6) lying supine on the mattress. The size of the mattress 1 is set, for example, to suit an adult of a standard physique (e.g., a Japanese adult male who is approximately 170 centimeters tall and weighing 70 kilograms). In the present invention, the mattress 1 may have a size capable of supporting a region corresponding to at least a back 52 (see FIGS. 4 to 6) of the human 50 in a supine position.

In the present specification and the drawings, to represent directions, a direction X (a head side X1, a leg side X2) in which a body of the human 50 in the supine position extends, a width direction of the body of the human 50 in the supine position (hereinafter referred to as a width direction) Y (a right side Y1, a left side Y2), and a thickness direction Z (an upper side Z1, a lower side Z2) of the mattress 1 are defined.

Parts of the mattress 1 that are designed to come into contact with the back 52, a pelvis PV, and legs of the human 50 in the supine position have shapes protruding to the upper side Z1. Specifically, the mattress 1 includes a base 2 having a flat rectangular parallelepiped shape and three parts, i.e., a back supporting section 3, a pelvis supporting section 4, and a leg supporting section 5, protruding from an upper surface 2*a* of the base 2 to the upper side Z1. The back supporting section 3 has a reference surface 100 to support the back 52 of the human 50 in the supine position (see FIGS. 4 to 6). The pelvis supporting section 4 is located nearer to the leg side X2 than the back supporting section 3 is and supports a region corresponding to the pelvis PV (see FIGS. 4 to 5). The leg supporting section 5 is located nearer to the leg side X2 than the pelvis supporting section 4 is and supports a region corresponding to a part in a vicinity of femurs FM (see FIGS. 4 to 5) in the legs.

In the mattress 1, a head disposition space 6 where a head 51 (see FIG. 4) is disposed is formed on the head side X1 relative to the back supporting section 3. The head disposition space 6 is an area where the upper surface 2*a* of the base 2 is exposed and a pillow P is disposed to support the head 51.

In the mattress 1, a hip joint disposition space 7 having a step area 7*a* is formed between the pelvis supporting section 4 and the leg supporting section 5. Hip joints J (see FIGS. 4 to 5) are disposed in the step area 7*a* that is depressed farther than the reference surface 100 that constitutes an upper surface of the back supporting section 3. The hip joints J of the human 50 in the supine position are accommodated in the step area 7*a*.

When the human is in the supine position, whereas the pelvis supporting section 4 (specifically, an ilium supporting section 11 described later) and the leg supporting section 5 are collapsed by weight of the human 50, the step area 7*a* is not collapsed. As a result, the hip joints J are in a state of not being supported. Thus, a depth of the step area 7*a* is set to such a degree that the step area 7*a* is not collapsed even by the weight of the human 50.

(Description of back 52)

Figure 7:
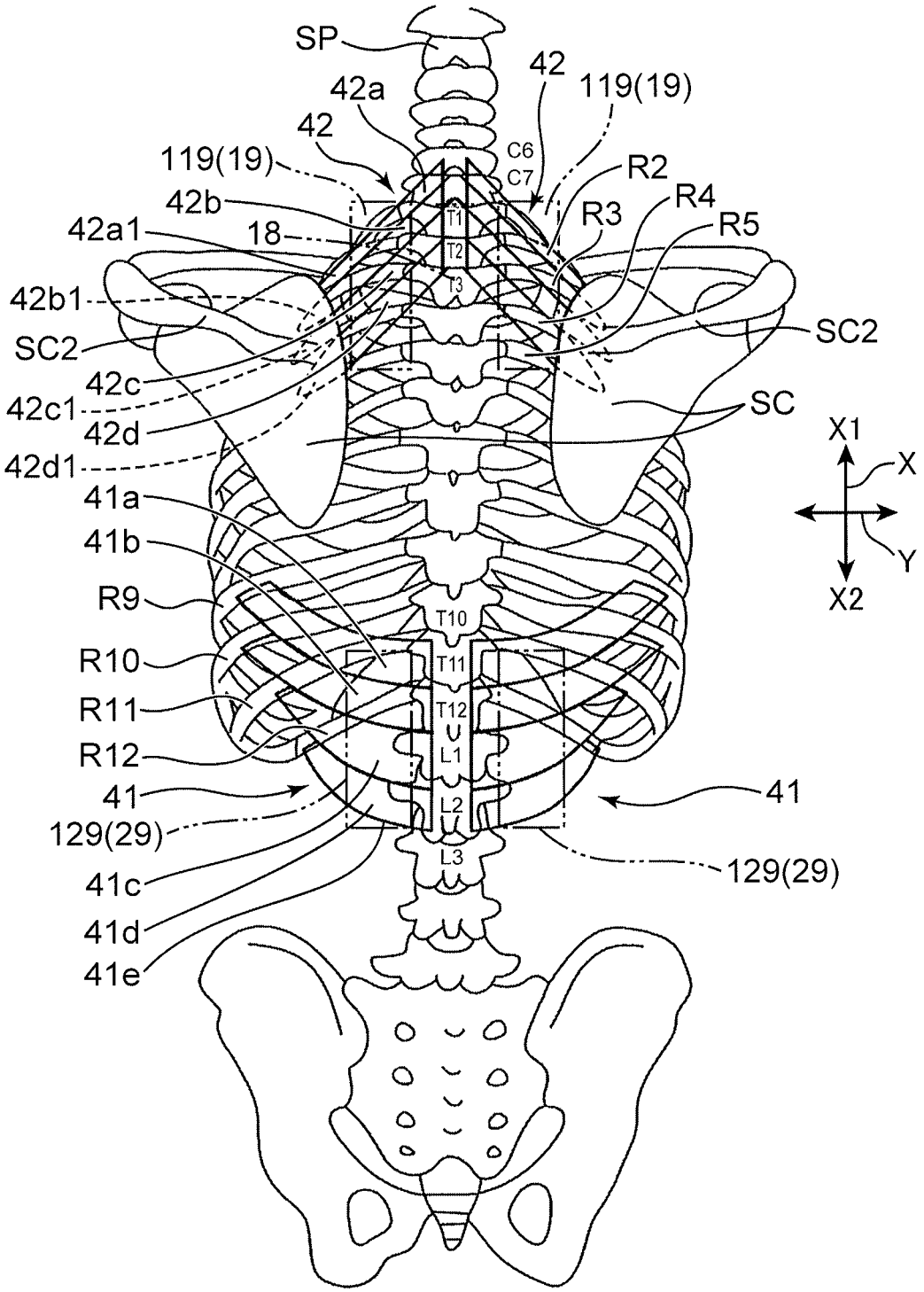
FIG. 7 is a schematic illustrative drawing showing a disposition of a serratus posterior inferior muscle and a serratus posterior superior muscle of a human and a serratus posterior superior step area and a serratus posterior inferior step area of the mattress in FIG. 1.

As shown in FIG. 7, there are a pair of serratus posterior inferior muscles 41 and a pair of serratus posterior superior muscles 42 inside the back 52 supported by the back supporting section 3. These muscles are responsible for breathing of the human 50 in the supine position.

The pair of the serratus posterior inferior muscles 41 are arranged at left and right sides of a leg side part of a spine SP of the human in the supine position. The serratus posterior inferior muscles 41 each have four parts 41*a* to 41*d*. The four parts 41*a* to 41*d* of the serratus posterior inferior muscle 41 line up in order from the head side to the leg side and each extend in a direction toward the leg side X2 with an outward advancement in the width direction Y (a lateral direction). Thus, an overall shape of the serratus posterior inferior muscle 41 is substantially a parallelogram. The four parts 41*a* to 41*d* connect an 11th thoracic vertebra T11 through a second lumbar vertebra L2 on an origin side (i.e., the 11th thoracic vertebra T11, a 12th thoracic vertebra T12, a first lumbar vertebra L1, and the second lumbar vertebra L2) with a ninth rib R9 through a 12th rib R12 on an insertion side, respectively.

The pair of the serratus posterior superior muscles 42 are arranged at left and right sides of a head side part of the spine SP of the human in the supine position. The serratus posterior superior muscles 42 each have four parts 42*a* to 42*d*. The four parts 42*a* to 42*d* line up in order from the head side to the leg side and each extend in a direction toward the head side X1 with an outward advancement in the width direction Y (the lateral direction). Thus, an overall shape of the serratus posterior superior muscle 42 is substantially a parallelogram. The four parts 42*a* to 42*d* connect a sixth cervical vertebra C6 through a second thoracic vertebra T2 on the origin side (i.e., the sixth cervical vertebra C6, a seventh cervical vertebra C7, a first thoracic vertebra T1, and the second thoracic vertebra T2) with a second rib R2 through a fifth rib R5 on the insertion side, respectively. The serratus posterior superior muscle 42 is connected with the second rib R2 through the fifth rib R5 but is not connected with a scapula SC. Specifically, an end 42*al* of the part 42*a*, which is farthest on the head side X1 of the serratus posterior superior muscle 42, is connected with the second rib R2 and is located nearer to the spine SP than the scapula SC is. Ends 42*b*1 to 42*d*1 of the other three parts 42*b* to 42*d* of the serratus posterior superior muscle 42, which are connected with a third rib R3 through the fifth rib R5, are located in an area where the scapula SC and the third rib R3 through the fifth rib R5 overlap vertically. The ends 42*b*1 to 42*d*1 are connected only with the ribs but are not connected with the scapula SC.

When a human breathes in and out, a group including 12 pairs of ribs that forms a rib cage during breathing moves to assist a diaphragm DP (see FIG. 5) in moving upward and downward. Specifically, during breathing out, the rib group forming the rib cage is pulled down by contraction of the serratus posterior inferior muscles 41, and the rib cage narrows. During breathing in, the rib group is pulled up by contraction of the serratus posterior superior muscles 42, and the rib cage expands. Since the ribs are connected by intercostal muscles, the whole rib group moves upward and downward.

In the present embodiment, the mattress 1 has a structure of the back supporting section 3 as described below not to restrict freedom of the serratus posterior superior muscles 42 in the supine position in pulling up the rib group.

(Description of Back Supporting Section 3)

In the present embodiment, a part of the back supporting section 3 on the head side X1 is designed not to restrict freedom of the serratus posterior superior muscles 42 in pulling up the rib group, and as shown in FIGS. 1 to 7, the back supporting section 3 includes a pair of scapula supporting sections 20, a pair of serratus posterior superior corresponding parts 19, a thoracic vertebra supporting section 18, a sixth thoracic vertebra corresponding part 23, a pair of levator scapula pressing parts 24, a pair of rib pressing parts 27, and a pair of serratus posterior inferior corresponding parts 29.

The pair of the serratus posterior superior corresponding parts 19 are each disposed below a region corresponding to at least a middle part between origin and insertion of each of the pair of the left and right serratus posterior superior muscles 42 of the human 50 in the supine position. The serratus posterior superior corresponding parts 19 are configured such that body pressure from the serratus posterior superior corresponding parts 19 is lower than body pressure from the scapula supporting sections 20 with the human lying supine on the mattress 1. In the present embodiment, the scapula supporting sections 20 are set at a level flush with the reference surface 10, and the serratus posterior superior corresponding parts 19 each include a serratus posterior superior step area 119 that has a substantially rectangular shape in plan view. The serratus posterior superior step area 119 is depressed farther than the reference surface 100, which constitutes the upper surface of the back supporting section 3, and corresponds to a first step area according to the present invention. In the present embodiment, a pair of the serratus posterior superior step areas 119 are each formed in a zone corresponding to at least the middle part between the origin and the insertion of each of the pair of the serratus posterior superior muscles 42, which is a region corresponding to a part of the serratus posterior superior muscle 42 that contracts and stretches to a largest degree. Specifically, the zone is located between the spine SP and the scapula SC of the human in the supine position. This makes it possible to reliably avoid pressure on a part of the serratus posterior superior muscle 42 that greatly helps to pull up the rib group.

The pair of the scapula supporting sections 20 disposed outside the pair of the serratus posterior superior corresponding parts 19 in the width direction Y support regions corresponding to a pair of the left and right scapulae SC. In the present embodiment, the pair of the scapula supporting sections 20 each include an upper surface flush with the reference surface 100 and a head side step area 22.

The head side step area 22 is a part on the head side X1 of the scapula supporting section 20 and is disposed below a region corresponding to a part on the head side X1 of the scapula SC. The head side step area is depressed farther than the reference surface 100 and corresponds to a third step area according to the present invention. The head side step area 22 is formed, for example, in a zone including at least a part of (preferably a whole of) a scapular spine SC2 (see FIGS. 5 and 7) and, in other words, is formed in a zone equivalent to approximately one fourth on the head side X1 of the scapula SC in a length range in a direction of height of the human.

The pair of the levator scapula pressing parts 24 are each located outside a middle place in the width direction Y of a levator scapula muscle 40 (see FIG. 5) of the human in the supine position and are each disposed at a place where the levator scapula muscle 40 is allowed to be pressed from outside to inside in the width direction Y. Specifically, the levator scapula pressing part 24 is disposed between the serratus posterior superior step area 119 and the head side step area 22 of the scapula supporting section 20 on either side of the thoracic vertebra supporting section 18 in the width direction Y. The levator scapula pressing part 24 is joined to an extension part 26 protruding to the head side X1 from an end of the scapula supporting section 20 that is on the head side X1 and on an inner side in the width direction Y.

The levator scapula pressing part 24 works to press the levator scapula muscle 40 (see FIG. 5) of the human in the supine position from outside and facilitate upward rotation of the scapula SC (i.e., turning of a part SC1 on the leg side of the scapula SC to outside in the width direction Y and to the head side X1).

In the present embodiment, the levator scapula pressing part 24 protrudes upward beyond the reference surface 100 and is configured to press the levator scapula muscle 40 at a place higher than the reference surface 100 from outside to inside in the width direction Y. The levator scapula muscle 40 is readily pressed at a high place.

In the present embodiment, as shown in FIGS. 1 to 2 and FIGS. 4 to 5, the pair of the levator scapula pressing parts 24 are disposed inside a pair of the head side step areas 22 in the width direction Y and each support a region from a part on the inner side and the head side of the scapula SC through a neighborhood of a shoulder. This makes it possible to suppress pressure on an upper part of the serratus posterior superior muscle 42 even if the head side step area 22 described above constitutes a substantial area of the scapula supporting section 20.

In the present embodiment, the serratus posterior superior step areas 119 are depressed farther than the reference surface 100 of the back supporting section 3, and the body pressure from the serratus posterior superior step areas 119 is thereby lower than the body pressure from the scapula supporting sections 20.

Figure 3:
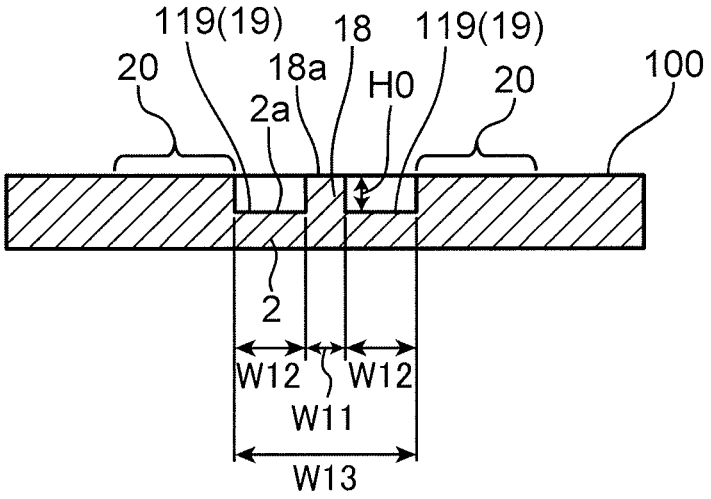
FIG. 3 is a cross-sectional view of the mattress taken along line III-III in FIG. 1.
Figure 4:
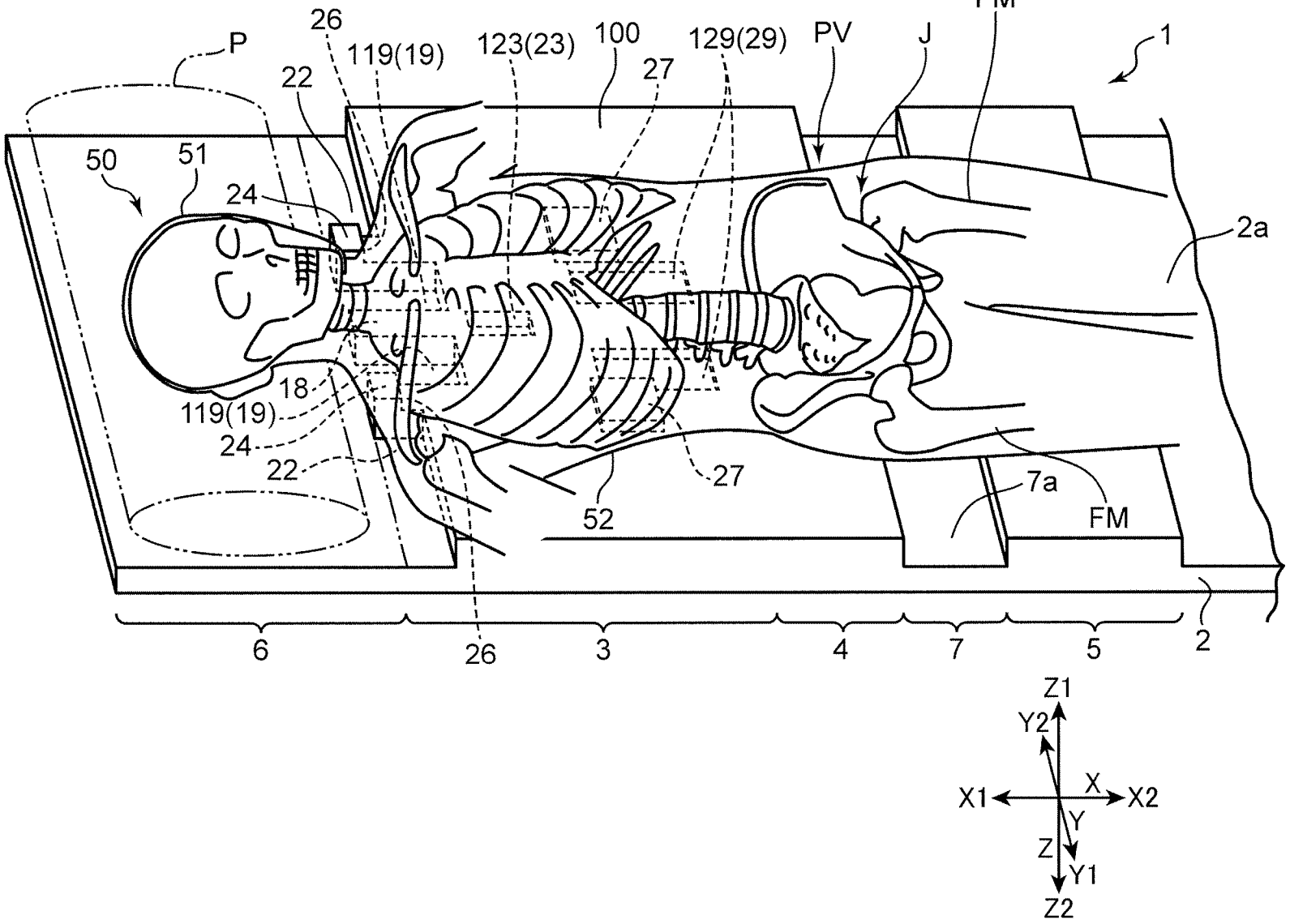
FIG. 4 is an illustrative drawing showing a state of the mattress in FIG. 1 on which a human is lying supine.

As shown in FIG. 3, a depth H0 of the serratus posterior superior step areas 119 is set at a height to a degree such that even when the reference surface 100 is pressed down in the supine position, a relationship, i.e., the body pressure from the pair of the serratus posterior superior step areas 119 being lower than the body pressure from the reference surface 100 and the scapula supporting sections 20, is maintained. The body pressure from the serratus posterior superior step area 119 is non-pressure when a region corresponding to the serratus posterior superior muscle 42 is not put into contact with the serratus posterior superior step area 119 with the reference surface 100 being pressed down in the supine position. The depth is set such that even when the region is put into contact with the serratus posterior superior step area 119, the body pressure from the step area 119 is lower than the body pressure from the reference surface 100 that is generated as a result of compression of the reference surface 100 by the height H0. Preferably, in the mattress 1, a degree of hardness of the serratus posterior superior step area 119 is set to a level lower than a degree of hardness of the reference surface 100. This further decreases the pressure from the step area 119.

Values of the body pressure from the reference surface 100, the scapula supporting sections 20, and the serratus posterior superior step areas 119 are measured by, for example, a device such as an existing body pressure measuring device. With an area on the mattress 1 being divided into a matrix of squares, the body pressure measuring device is used to measure a load on each square as a value of body pressure. By using the body pressure measuring device, values of the body pressure from the reference surface 100, the scapula supporting sections 20, and the serratus posterior superior step areas 119 can be measured, for example, as average values of the values of body pressure applied from the scapula supporting section 20 to areas for the region corresponding to the scapula SC and average values of the values of body pressure applied from the serratus posterior superior step area 119 to areas for the region corresponding to the serratus posterior superior muscle 42.

A width W12 of the serratus posterior superior step area 119 may be a width that covers a zone that is in each of the pair of the serratus posterior superior muscles 42 and that is located between the spine SP and the scapula SC of the human in the supine position. A specific numerical range of the width W12 will be described later in relation to a width W11 of the thoracic vertebra supporting section 18.

Figure 6:
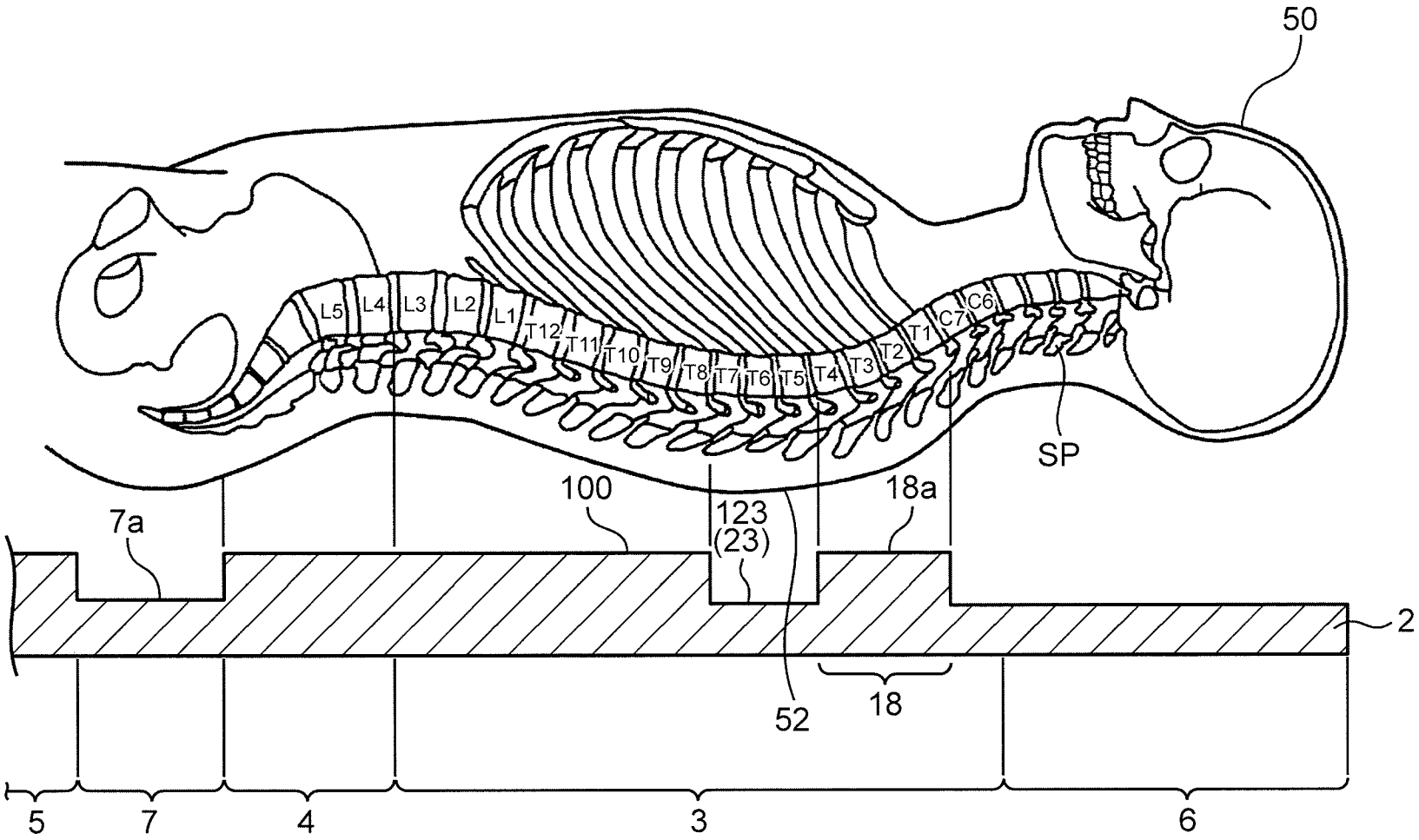
FIG. 6 is a schematic longitudinal cross-sectional view of the mattress in FIG. 1 and a human, showing a relative positional relationship between the mattress and a skeleton of the human in a supine position.

The thoracic vertebra supporting section 18 is disposed between the pair of the serratus posterior superior step areas 119 and supports a continuous region corresponding to an area of three or more consecutive thoracic vertebrae including at least the first thoracic vertebra T1 through a third thoracic vertebra T3 of the spine SP at the back 52 of the human 50 in the supine position. The thoracic vertebra supporting section 18 in the present embodiment, as shown in FIGS. 1 and 6, supports consecutive parts of the spine of the human in the supine position together with a lumbar vertebra side supporting section 8 described later. An upper surface 18*a* of the thoracic vertebra supporting section 18 is flush with the reference surface 100, extends continuously in the direction X in which the human body extends, and is able to support the first thoracic vertebra T1 through the third thoracic vertebra T3 consecutively.

Figure 5:
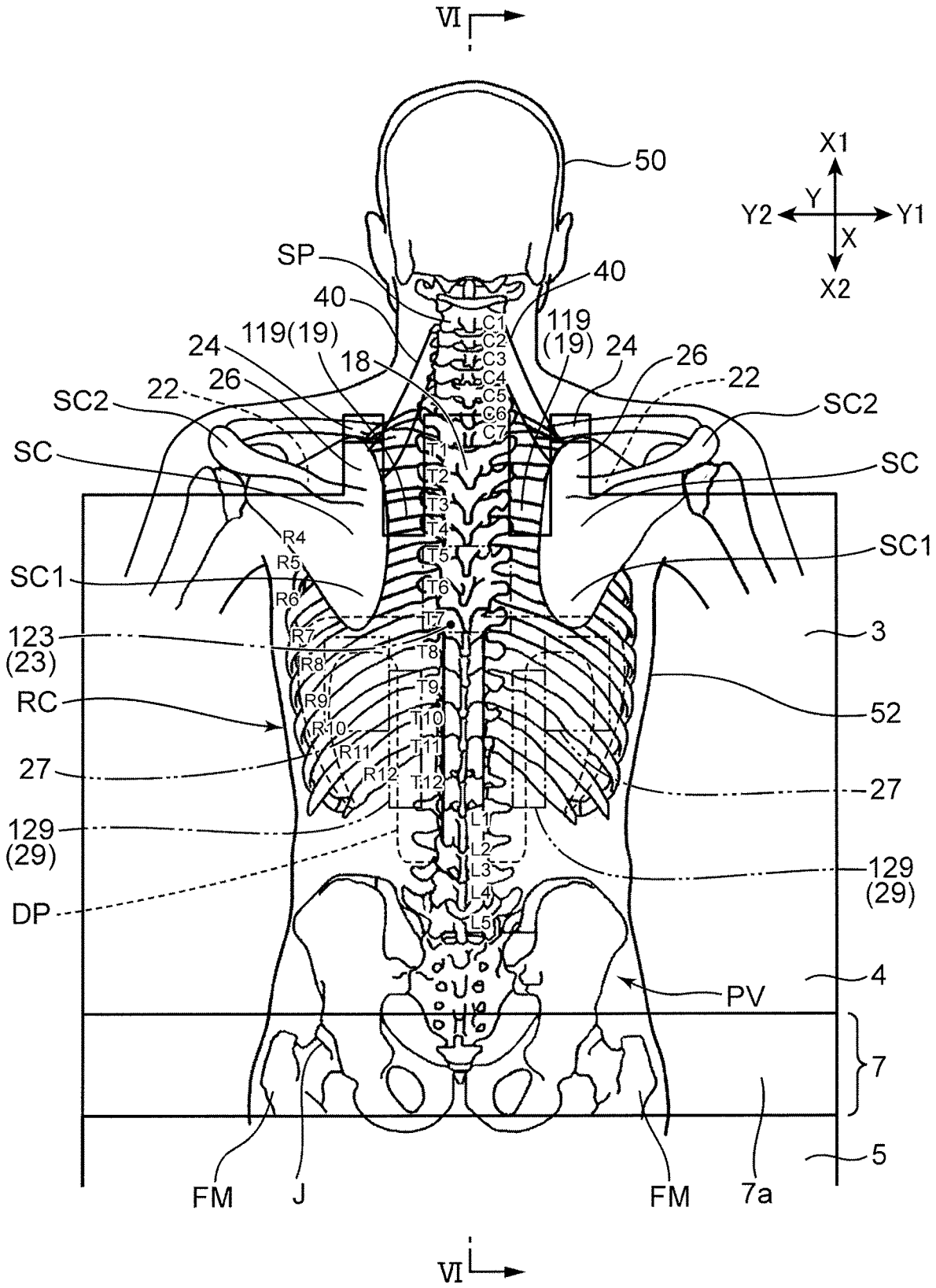
FIG. 5 is a schematic back elevation of the mattress in FIG. 1 and a human, showing a relative positional relationship between the mattress and a skeleton of the human in a supine position.

A length of the thoracic vertebra supporting section 18 (a length in the direction X in which the human body extends) may be a satisfactory length to support a continuous region corresponding to an area of three or more consecutive thoracic vertebrae including at least the first thoracic vertebra T1 through the third thoracic vertebra T3 of the spine SP at the back 52 of the human 50 in the supine position. In FIGS. 5 to 7, the thoracic vertebra supporting section 18 has a satisfactory length to support three consecutive regions corresponding to the first thoracic vertebra T1 through the third thoracic vertebra T3 of the spine SP. However, the length may be another length that covers a range of four consecutive thoracic vertebrae, such as a range from the first thoracic vertebra T1 through a fourth thoracic vertebra T4.

Body pressure in a neighborhood of a sixth thoracic vertebra T6 (a range of a neighborhood of a fifth thoracic vertebra T5 through a seventh thoracic vertebra T7) of the spine is likely to be high in the supine position. Thus, in the present embodiment, the sixth thoracic vertebra corresponding part 23 that includes a thoracic vertebra step area 123 described later is disposed to decrease the body pressure on the neighborhood of the sixth thoracic vertebra T6. This avoids hindrance to flexible movement of the spine during breathing in the supine position.

Since body pressure on the serratus posterior superior muscles 42 is received by the scapulae SC and upper thoracic vertebrae (the first thoracic vertebra T1 through the third thoracic vertebra T3), the thoracic vertebra supporting section 18 does not need to support cervical vertebrae in terms of avoidance of pressure on the serratus posterior superior muscles 42. The cervical vertebrae are under the influence of the head in the supine position (in other words, the cervical vertebrae are influenced by weight of the head), and thus the cervical vertebrae are influenced by a pillow that supports the head. Further, since supporting the head possibly increases tension in muscles around the neck that are used during breathing, it is preferable to avoid support provided by the thoracic vertebra supporting section 18 to the cervical vertebrae. From this point of view, even if the cervical vertebrae are supported by the thoracic vertebra supporting section 18, the seventh cervical vertebra C7, which has least influence on tension in muscles around the neck, may be supported, but support for the sixth cervical vertebra C6 and other cervical vertebrae at the head side thereof, which have a substantial influence, is preferably avoided.

When supporting consecutive thoracic vertebrae, the thoracic vertebra supporting section 18 may individually support the thoracic vertebrae in the range described above. Hence, the thoracic vertebra supporting section 18 is not limited to such a shape that the supporting section extends continuously in the direction X in which the human body extends, but may have a shape that has interruptions or gaps with proviso that any interruption or gap is not equal to or greater than one thoracic vertebra.

Figure 2:
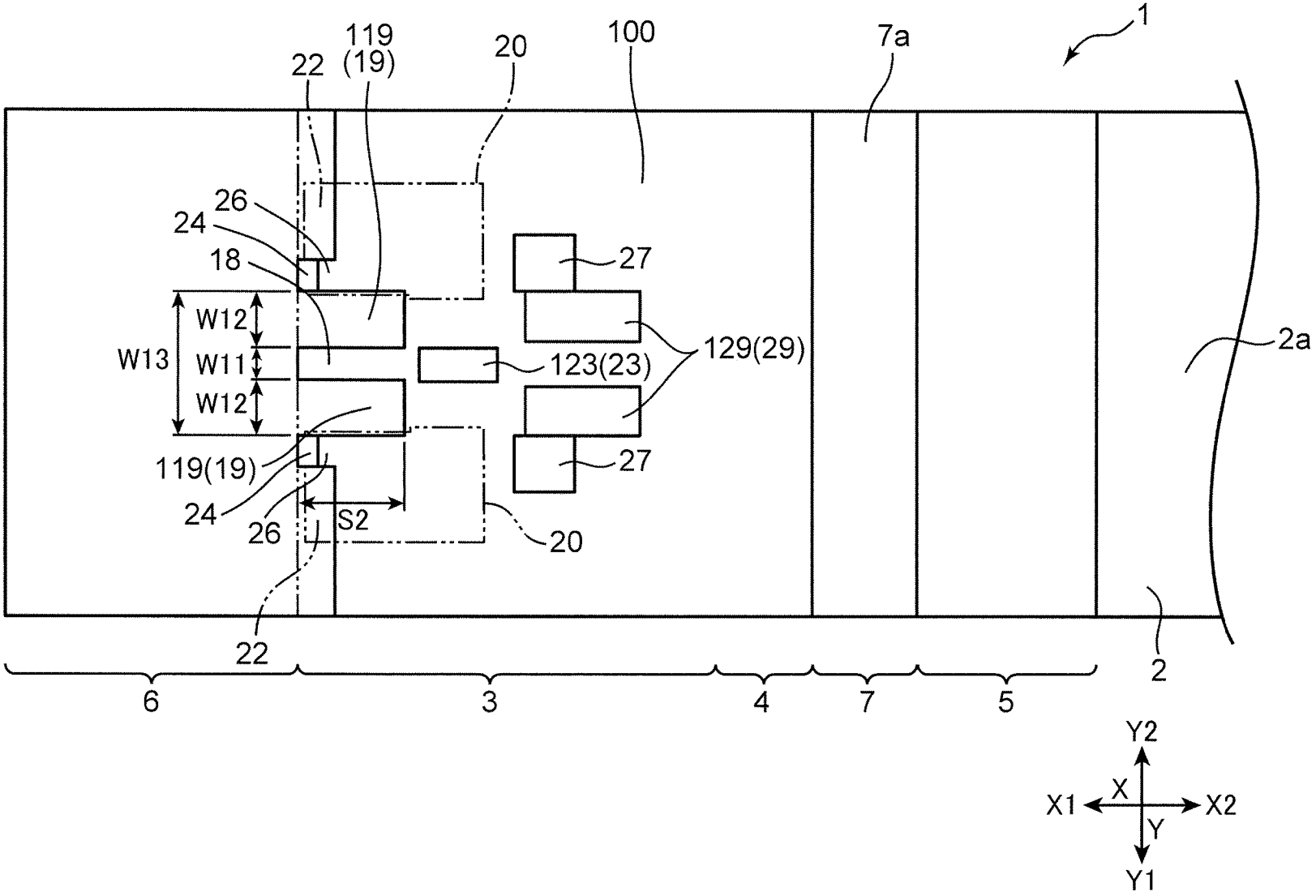
FIG. 2 is a plan view of the mattress in FIG. 1.

The width W11 of the thoracic vertebra supporting section 18 shown in FIGS. 2 to 3 is set to within a range of the region corresponding to an area of three or more consecutive thoracic vertebrae including at least the first thoracic vertebra T1 through the third thoracic vertebra T3. In other words, the width W11 of the thoracic vertebra supporting section 18 is set to a range such that the supporting section comes into contact with the region corresponding to an area of three or more consecutive thoracic vertebrae including at least the first thoracic vertebra T1 through the third thoracic vertebra T3 but does not come into contact with regions corresponding to ribs R1 to R3 extending at both the left and right sides of the thoracic vertebrae T1 through T3 (both sides in the width direction Y).

With reference to FIGS. 2 to 3, numerical ranges of the width W11 of the thoracic vertebra supporting section 18 and the width W12 of the serratus posterior superior step area 119 will now be described. Specifically, if a Japanese adult of a standard physique is a point of reference, it is preferable to set the width W11 of the thoracic vertebra supporting section 18 to a range of 4 cm to 11 cm (preferably, approximately 6 cm to 9 cm). If the width W11 is less than 4 cm, the area supporting the region corresponding to the thoracic vertebrae is too small. This disadvantageously prevents coordinated movement of the thoracic vertebrae from being maintained. On the other hand, if the width W11 is greater than 11 cm, the thoracic vertebra supporting section 18 presses not only the thoracic vertebrae but also the ribs at both sides of the thoracic vertebrae. This disadvantageously hinders breathing-in motion. Therefore, it is preferable, as described above, to set the width W11 of the thoracic vertebra supporting section 18 to a range of 4 cm to 11 cm as a range that ensures that the ribs are not pressed while coordination of the thoracic vertebrae is maintained.

The width W12 of the serratus posterior superior step area 119 is set as described below with the width W11 and a space between the scapulae SC being taken into consideration. In other words, the width W12 of the serratus posterior superior step area 119 described above is set such that a sum total W13 (=W12+W11+W12) of the width W11 of the thoracic vertebra supporting section 18 and the width W12 of each of the pair of the serratus posterior superior step areas 119 is equal to or slightly greater than a space (approximately 16 cm to 24 cm) between the left and right scapulae SC (see FIG. 5) of a Japanese adult of a standard physique. Specifically, W12=(W13−W11)/2=approximately 2.5 cm to 10 cm, where width W11=4 cm to 11 cm and sum total W13=16 cm to 24 cm, which matches the space between the scapulae.

The sixth thoracic vertebra corresponding part 23 is disposed below a region corresponding to an area of two or more consecutive thoracic vertebrae including at least the sixth thoracic vertebra of the spine at the back of the human in the supine position. In the present embodiment, the sixth thoracic vertebra corresponding part 23 includes the thoracic vertebra step area 123. The thoracic vertebra step area 123, which is disposed below a region corresponding to an area of two or more consecutive thoracic vertebrae including at least the sixth thoracic vertebra T6 of the spine SP at the back of the human in the supine position, is depressed farther than the reference surface 100 of the back supporting section 3 (i.e., depressed farther than the upper surface 18*a* of the thoracic vertebra supporting section 18). The thoracic vertebra step area 123 corresponds to a second step area according to the present invention. As shown in FIGS. 5 to 6, the thoracic vertebra step area 123 is formed, for example, in a region including the fifth thoracic vertebra T5 through the seventh thoracic vertebra T7, which is a region including the sixth thoracic vertebra T6. As shown in FIG. 6, the neighborhood of the sixth thoracic vertebra T6 is located at a lowest position among other thoracic vertebrae in a supine posture and thus body pressure on the sixth thoracic vertebra is highest in the supine position. The thoracic vertebra step area 123 disposed there helps to alleviate the body pressure and facilitate flexible movement of the spine.

The pair of the serratus posterior inferior corresponding parts 29 are each disposed below a region corresponding to at least a middle part between origin and insertion of each of the pair of the left and right serratus posterior inferior muscles 41 (see FIG. 7) of the human in the supine position.

The serratus posterior inferior corresponding parts 29 are configured such that body pressure from the serratus posterior inferior corresponding parts 29 is lower than body pressure from a portion of the back supporting section 3 other than the serratus posterior inferior corresponding parts 29.

In the present embodiment, the serratus posterior inferior corresponding part 29 includes a serratus posterior inferior step area 129 that is depressed farther than the reference surface 100. The serratus posterior inferior step area 129 corresponds to a fourth step area according to the present invention.

This step area is configured so that: the body pressure from the serratus posterior inferior step area 129 is non-pressure when a region corresponding to the serratus posterior inferior muscle 41 is not put into contact with the serratus posterior inferior step area 129 with the reference surface 100 being pressed down in the supine position; and even when the region is put into contact with the serratus posterior inferior step area 129, the body pressure from the serratus posterior inferior step area 129 due to a compression caused by a height difference with respect to the reference surface 100 is lower than the body pressure from the reference surface 100. Preferably, in the mattress 1, a degree of hardness of the serratus posterior inferior step area 129 is set to a level lower than a degree of hardness of the reference surface 100. This further decreases the pressure from the step area 129.

The pair of the rib pressing parts 27 disposed outside the pair of the serratus posterior inferior corresponding parts 29 in the body width direction Y are located below regions corresponding to pairs of at least eighth ribs R8 and the ninth ribs R9 of the human in the supine position. The rib pressing parts protrude beyond the reference surface 100 to the upper side Z1. The rib pressing parts 27 are each designed to press ribs including at least the eighth rib R8 and the ninth rib R9 (e.g., a seventh rib R7 through a 11th rib R11) from below. This helps a lower portion of the rib cage to open toward the head side X1 and facilitates breathing-in motion.

(Characteristics of Present Embodiment)

(1)

The inventor of the present invention, with the aim of facilitating breathing in a supine position, has extensively studied on ways of removing pressure that hinders the serratus posterior superior muscles 42 from moving to pull up ribs during breathing in and, as a result, has invented the mattress 1 described below.

In other words, the mattress 1 of the present embodiment includes the back supporting section 3 to support the back of the human in the supine position. The back supporting section 3 has an upper surface to support the back of the human. The upper surface of the back supporting section 3 constitutes the reference surface 100 of the mattress 1. The back supporting section 3, as shown in FIGS. 1 to 3 and FIGS. 6 to 7, includes the pair of the serratus posterior superior corresponding parts 19 that are each disposed on the lower side Z2 of a region corresponding to at least a middle part between the origin and the insertion of each of the pair of the left and right serratus posterior superior muscles 42 of the human in the supine position (specifically, a part between the spine SP and the scapula SC) and the pair of the scapula supporting sections 20 disposed outside the pair of the serratus posterior superior corresponding parts 19 in the width direction Y to support regions corresponding to the pair of the scapulae SC. The serratus posterior superior corresponding parts 19 and the scapula supporting sections 20 are configured such that the body pressure from the serratus posterior superior corresponding parts 19 is lower than the body pressure from the scapula supporting sections 20. This makes it possible to avoid pressure on the serratus posterior superior muscle 42, particularly the middle part of the serratus posterior superior muscle 42 that actively moves, in the supine position. Consequently, breathing-in motion is facilitated in the supine position.

(2)

In the mattress 1 of the present embodiment, the scapula supporting sections 20 are set at a level flush with the reference surface 100. Further, the serratus posterior superior corresponding parts 19 each include the serratus posterior superior step area 119 (the first step area) depressed farther than the reference surface 100, and thus the body pressure from the serratus posterior superior corresponding parts 19 is lower than the body pressure from the scapula supporting sections 20. As a result, with the serratus posterior superior step area 119, it is possible to reliably avoid pressure on the serratus posterior superior muscles 42. A level of the upper surface of the scapula supporting section 20 may be equal to or higher than a level of the reference surface 100 or may be higher than the reference surface 100.

(3)

In the mattress 1 of the present embodiment, the back supporting section 3 further includes the sixth thoracic vertebra corresponding part 23 disposed below a region corresponding to an area of two or more consecutive thoracic vertebrae including at least the sixth thoracic vertebra T6 of the spine SP at the back of the human in the supine position. The sixth thoracic vertebra corresponding part 23 is configured such that the body pressure from the sixth thoracic vertebra corresponding part 23 is lower than the body pressure from a portion of the back supporting section 3 supporting the spine other than the sixth thoracic vertebra corresponding part 23.

In this configuration, the sixth thoracic vertebra corresponding part 23 helps to avoid pressure on the neighborhood of the sixth thoracic vertebra T6 in the supine position and further facilitate breathing in the supine position.

A structure like the mattress of the present embodiment in which the pair of the serratus posterior superior corresponding parts 19 are disposed at both sides of a portion supporting the spine causes body pressure on the spine, particularly on the neighborhood of the sixth thoracic vertebra T6, to increase compared with the conventional mattress without a pair of serratus posterior superior corresponding parts 19. However, the mattress with the sixth thoracic vertebra corresponding part 23 as described above makes it possible to partly decrease the body pressure on the neighborhood of the sixth thoracic vertebra T6. Therefore, the mattress 1 of the present embodiment produces a synergy effect by an effect of the pair of the serratus posterior superior corresponding parts 19 on avoidance of pressure on the serratus posterior superior muscles 42 and an effect of the sixth thoracic vertebra corresponding part 23 on avoidance of pressure on the neighborhood of the sixth thoracic vertebra T6. This further facilitates breathing in the supine position and makes it possible to have a sleep with improved comfortableness.

More specifically, as shown in FIG. 6, the neighborhood of the sixth thoracic vertebra T6 is located at the lowest position among other thoracic vertebrae in a supine posture and thus body pressure on the sixth thoracic vertebra is the highest in the supine position. The thoracic vertebra step area 123 disposed there helps to alleviate the body pressure and facilitate flexible movement of the spine. This makes it easier for a sacrum in a center of the pelvis PV, which is linked with the spine, to move anterior into nutation (nutation movement). In response to this, the diaphragm DP readily rises and as a result, breathing is facilitated in the supine position.

A supplementary explanation about the nutation movement of the sacrum will be added. Being linked with the nutation movement of the sacrum through the spine during breathing, an occipital bone also moves. The human moves the head down during breathing in and moves the head up during breathing out. In the case of a conventional flat mattress structure that supports thoracic vertebrae and scapulae, the body pressure is concentrated most on the neighborhood of the sixth thoracic vertebra T6. There is a risk that if the sixth thoracic vertebra T6 is unable to move due to high body pressure, breathing may be hindered as the link with the nutation movement of the sacrum through the spine is broken off and the movement is not transmitted to the head. To avoid such a hindrance to the breathing movement, alleviation of the body pressure on the neighborhood of the sixth thoracic vertebra T6 through the disposition of the sixth thoracic vertebra corresponding part 23, specifically the thoracic vertebra step area 123, is highly effective, as in the mattress of the present embodiment.

(4)

In the mattress 1 of the present embodiment, the sixth thoracic vertebra corresponding part 23 includes the thoracic vertebra step area 123 (the second step area) that is depressed farther than the reference surface 100. In this simple configuration, the step area helps to avoid pressure on the neighborhood of the sixth thoracic vertebra T6 and further facilitate breathing in the supine position.

In the supine position, the neighborhood of the sixth thoracic vertebra T6 of the spine SP at the back of the human is likely to be pressed. However, in the configuration described above, the back supporting section 3 includes the thoracic vertebra step area 123 that is depressed farther than the reference surface 100. This makes it possible to partly decrease the body pressure on the area of two or more consecutive thoracic vertebrae including the sixth thoracic vertebra T6. This makes it possible to maintain seamless movement of the whole spine SP in the supine position and reliably maintain breathing in the supine position.

(5)

In the mattress 1 of the present embodiment, the scapula supporting sections 20 each further include the head side step area 22 (the third step area) that is disposed below a region corresponding to a part on the head side X1 of the scapula SC (specifically, a portion including at least a part of the scapular spine SC2) and that is depressed farther than the reference surface 100. This helps to avoid pressure on the scapular spine SC2 and facilitate upward rotation of the scapula SC in the supine position. This also makes it easier to move clavicles and the rib cage to the head side, and thus breathing-in motion is further facilitated in the supine position.

In other words, in the present embodiment, the head side step area 22 is disposed by which pressure is not applied from the mattress to a portion of the scapular spine SC2 on a shoulder joint side (on an outer side in the width direction Y). Thus, the portion of the scapular spine SC2 on the shoulder joint side of the human in the supine position is pulled to the lower side Z2 of the mattress by gravity. This results in a pressure difference (unbalanced contact) in a surface put into contact with ribs, and the pressure difference together with body pressure on the scapula SC further facilitates upward rotation. The upward rotation is facilitated more effectively in response to a widening of the head side step area 22.

(6)

In the mattress 1 of the present embodiment, the back supporting section 3 further includes the pair of the serratus posterior inferior corresponding parts 29 that are each disposed below a region corresponding to at least a middle part between the origin and the insertion of each of the pair of the left and right serratus posterior inferior muscles 41 (see FIG. 7) of the human in the supine position. The serratus posterior inferior corresponding parts 29 are configured such that body pressure from the serratus posterior inferior corresponding parts 29 is lower than body pressure from a portion of the back supporting section 3 other than the serratus posterior inferior corresponding parts 29.

This configuration makes it possible to avoid pressure on the serratus posterior inferior muscle 41, particularly the middle part of the serratus posterior inferior muscle 41 that actively moves, in the supine position. Consequently, breathing-out motion is facilitated in the supine position.

(7)

In the mattress 1 of the present embodiment, the serratus posterior inferior corresponding part 29 includes the serratus posterior inferior step area 129 (the fourth step area) that is depressed farther than the reference surface 100. Thus, the body pressure from the serratus posterior inferior corresponding parts 29 is lower than the body pressure from a portion of the back supporting section 3 other than the serratus posterior inferior corresponding parts 29. As a result, with the serratus posterior inferior step areas 129, it is possible to reliably avoid pressure on the serratus posterior inferior muscles 41.

(8)

In the mattress of the present embodiment, the back supporting section 3 includes the pair of the rib pressing parts 27 that are disposed outside the pair of the serratus posterior inferior corresponding parts 29 in the body width direction Y and that are located below regions corresponding to pairs of at least the eighth ribs R8 and the ninth ribs R9 of the human in the supine position. The rib pressing parts protrude beyond the reference surface 100 to the upper side Z1. The rib pressing parts 27 are each designed to press ribs including at least the eighth rib R8 and the ninth rib R9 (e.g., the seventh rib R7 through the 11th rib R11) from below. This helps the lower portion of the rib cage to open toward the head side X1 and the thoracic vertebrae to slightly bend into an almost ideal state, facilitating breathing-in motion.

(9)

In the mattress 1 of the present embodiment, the back supporting section 3 includes the levator scapula pressing parts 24 that are each located outside a middle place in the width direction Y of the levator scapula muscle 40 of the human in the supine position and that are each disposed at a place where the levator scapula muscle 40 is allowed to be pressed from outside to inside in the width direction Y.

In this configuration, the levator scapula pressing part 24 presses the levator scapula muscle 40 from outside to inside and thereby facilitates upward rotation of the scapula SC in the supine position.

In the present embodiment, the head side step area 22 (the third step area) is below the scapular spine SC2. This further facilitates upward rotation of the scapula SC with the levator scapula pressing part 24 pressing the levator scapula muscle 40 while pressure on the scapular spine SC2 is avoided. The head side step area 22 (the third step area) may not be included, in other words, a portion of the scapula supporting section 20 below the scapular spine SC2 may be constituted by the reference surface 100.

(10)

In the mattress 1 of the present embodiment, the levator scapula pressing part 24 protrudes upward beyond the reference surface 100 and is configured to press the levator scapula muscle 40 at a place higher than the reference surface 100 from outside to inside in the width direction Y.

In this configuration, the levator scapula pressing part 24 presses the levator scapula muscle 40 at a place higher than the reference surface 100 from outside to inside and thereby further facilitates upward rotation of the scapula SC in the supine position.

In the present embodiment, an outside of a part of the scapula SC to which the levator scapula muscle 40 is attached (a head side of a superior angle of the scapula) is supported and pressed by body pressure, and the levator scapula muscle 40 is thereby pressed from outside to inside by the levator scapula pressing part 24. Since the part to which the levator scapula muscle 40 is attached (a neighborhood of the superior angle of the scapula) is pulled to a neck side, the levator scapula pressing part acts as a fulcrum and helps the scapula SC to move in a direction of upward rotation. The levator scapula pressing part 24 presses the levator scapula muscle 40 from outside to inside in the width direction Y and thereby helps the scapula SC to come off the ribs and move in the direction of upward rotation.

(11)

In the mattress 1 of the present embodiment, the pair of the serratus posterior superior step areas 119 are each formed in a zone that is in each of the pair of the serratus posterior superior muscles 42 and that is located between the spine SP and the scapula SC of the human in the supine position.

A part of the serratus posterior superior muscle 42 in the zone located between the spine SP and the scapula SC contracts and stretches to a large degree and greatly helps to pull up the rib group during breathing in. Hence, in this configuration, the serratus posterior superior step areas 119 are each formed in a zone that is in each of the pair of the serratus posterior superior muscles 42 and that is located between the spine SP and the scapula SC. This makes it possible to reliably avoid pressure on a part of the serratus posterior superior muscle 42 that greatly helps to pull up the rib group, as well as facilitate breathing with increased reliability.

(12)

In the mattress 1 of the present embodiment, the back supporting section 3 further includes the thoracic vertebra supporting section 18 that supports a continuous region corresponding to an area of three or more consecutive thoracic vertebrae including at least the first thoracic vertebra T1 through the third thoracic vertebra T3 of the spine SP at the back of the human in the supine position. The thoracic vertebra supporting section 18 is disposed between the pair of the serratus posterior superior step areas 119.

In this configuration, the thoracic vertebra supporting section 18 supports a continuous region corresponding to an area of three or more consecutive thoracic vertebrae including at least the first thoracic vertebra T1 through the third thoracic vertebra T3 of the spine SP. This enables flexible movement of the whole spine SP contiguous to the thoracic vertebrae during breathing and prevents movement of the ribs connected with the thoracic vertebrae from stopping during breathing. This makes it possible to simultaneously achieve the avoidance of pressure on the serratus posterior superior muscles 42 and the flexible movement of a superior part of the spine SP. This helps to facilitate breathing of the human in the supine position.

(Modifications)

(A)

In the mattress 1 of the embodiment described above, the serratus posterior superior corresponding parts 19 each include the serratus posterior superior step area 119 (the first step area) depressed farther than the reference surface 100. However, the present invention should not be limited to this. In the present embodiment, it is possible to avoid pressure on the serratus posterior superior muscles 42 in the supine position if the serratus posterior superior corresponding part 19 and a leg side supporting section 21 are configured such that body pressure from the serratus posterior superior corresponding parts 19 is lower than body pressure from the leg side supporting sections 21 and, as a result, the body pressure from the serratus posterior superior corresponding part is lower than the body pressure from the leg side supporting section.

Thus, in another modification of the present invention, the serratus posterior superior corresponding parts 19 and the leg side supporting sections 21 may be set at a level flush with the reference surface 100, and the serratus posterior superior corresponding parts 19 may be made of a material of a degree of hardness lower than a degree of hardness of the leg side supporting sections 21.

In such a configuration, the serratus posterior superior corresponding parts 19 and the leg side supporting sections 21 are at a level flush with the reference surface 100, which constitutes the upper surface of the back supporting section 3. This makes it possible to reduce unevenness of the upper surface of the back supporting section 3 and mitigate an uncomfortable feeling in the supine position. At the same time, since the degree of hardness of the serratus posterior superior corresponding parts 19 is lower than the degree of hardness of the leg side supporting sections 21, it is possible to avoid pressure on the serratus posterior superior muscles 42.

(B)

In the embodiment described above, the sixth thoracic vertebra corresponding part 23 includes the thoracic vertebra step area 123 (the second step area) that is depressed farther than the reference surface 100. However, the present invention should not be limited to this. The sixth thoracic vertebra corresponding part 23 is satisfactory with the proviso that the body pressure from the sixth thoracic vertebra corresponding part 23 is lower than the body pressure from the leg side supporting sections 21. Thus, the sixth thoracic vertebra corresponding part 23 and the leg side supporting sections 21 may be positioned at a level flush with the reference surface 100, and the sixth thoracic vertebra corresponding part 23 may be made of a material of a degree of hardness lower than a degree of hardness of the scapula supporting section 20. This case also helps to avoid pressure on the neighborhood of the sixth thoracic vertebra T6 and further facilitate breathing in the supine position.

(C)

Figure 8:
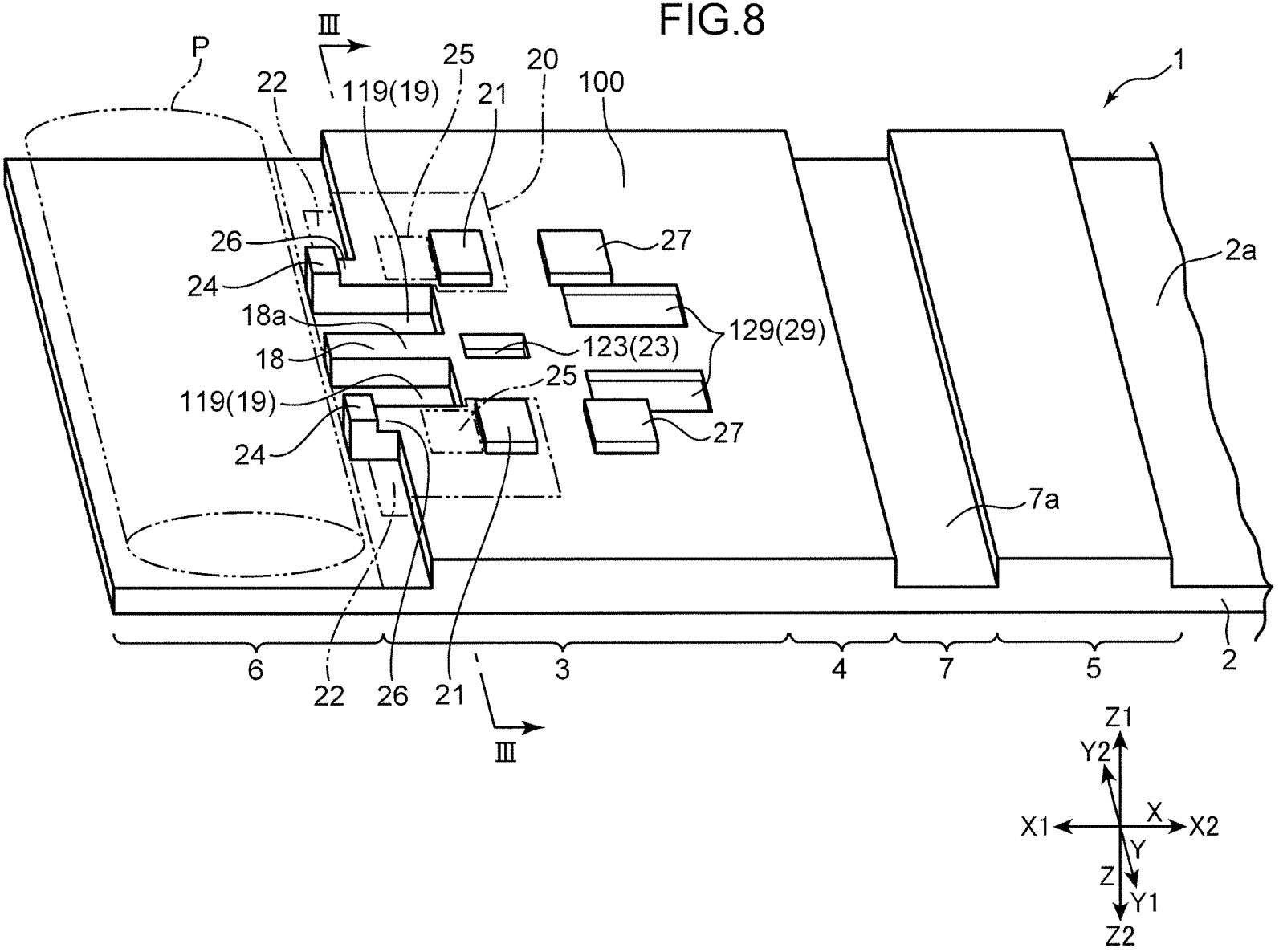
FIG. 8 is a perspective view showing an overall configuration of a mattress according to a modification of the present invention.
Figure 9:
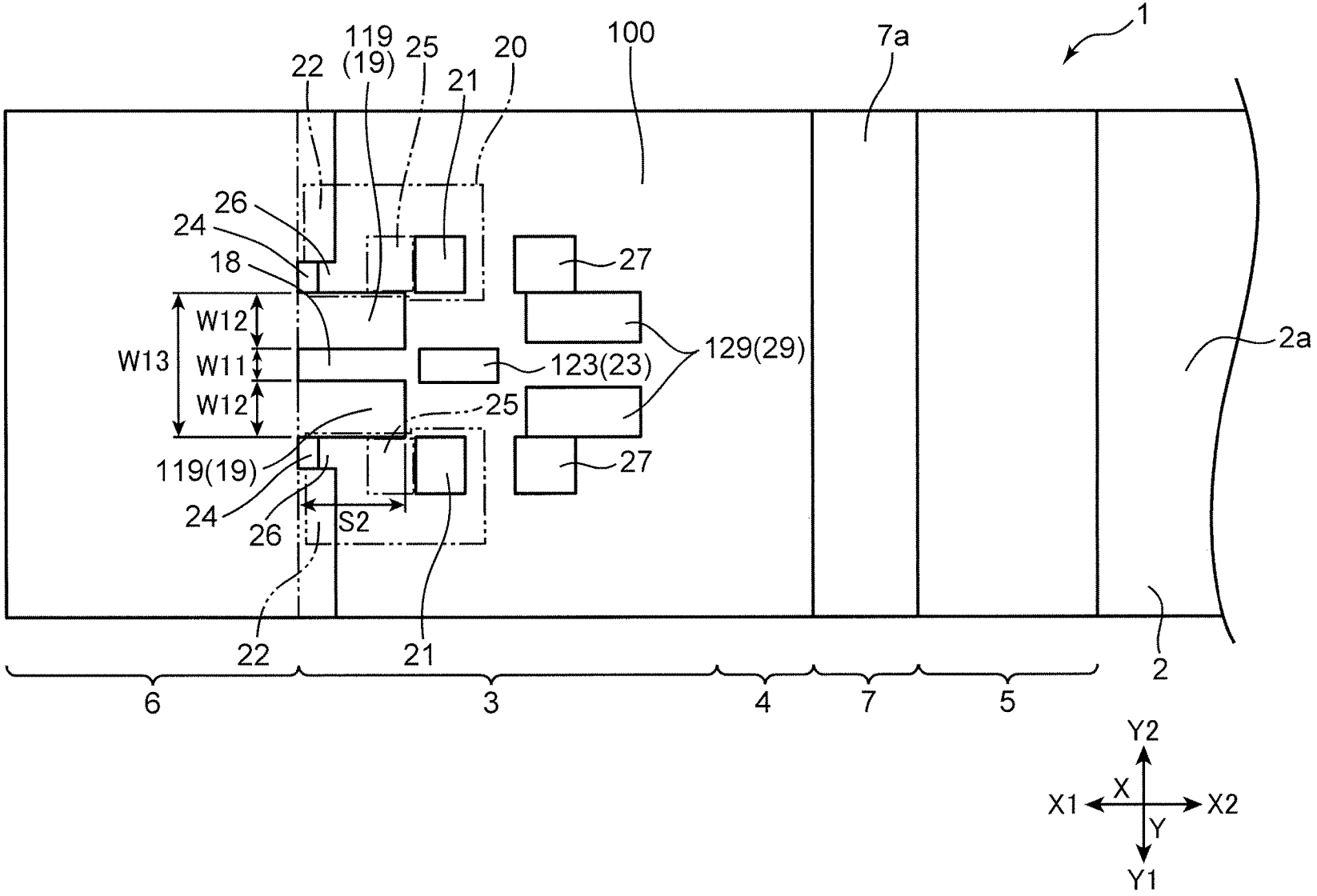
FIG. 9 is a plan view of the mattress in FIG. 8.

In a modification of the present invention, as shown in FIGS. 8 to 9, the pair of the scapula supporting sections 20 may each further include a leg side supporting section 21 and a head side corresponding part 25 located nearer to the head side X1 than the leg side supporting section 21, wherein the leg side supporting section 21 is relatively higher than the head side corresponding part 25. This configuration makes it possible to achieve both avoidance of pressure on a whole of the serratus posterior superior muscles 42 and facilitation of upward rotation of the scapulae SC in the supine position. Other components of a mattress shown in FIGS. 8 to 9 are shared with the mattress of the above embodiment shown in FIGS. 1 to 7.

The leg side supporting section 21 is a part that supports a region corresponding to the part SC1 of the scapula nearer to the leg side than the serratus posterior superior muscle 42 at a level equal to or higher than the reference surface 100. In the present embodiment, an upper surface of the leg side supporting section 21 is higher than the reference surface 100. In the scapula supporting sections 20, the leg side supporting sections 21 primarily support the scapulae SC, which may be subsidiarily supported or may not be supported by the head side corresponding parts 25.

In the modification (C) shown in FIGS. 8 to 9, the head side corresponding parts 25 are flush with the reference surface 100, and the leg side supporting sections 21 protrude so as to be higher than the reference surface 100. As a result, the leg side supporting sections 21 are higher than the head side corresponding parts 25. As described above, the serratus posterior superior muscle 42 is connected with the second rib R2 through the fifth rib R5 and has a part overlapping the scapula SC. However, these parts are not connected with the scapula SC, and the leg side supporting section 21 supports a region corresponding to the part SC1 of the scapula SC, which is nearer to the leg side than the serratus posterior superior muscle 42. Thus, body pressure received by the scapula SC helps to avoid pressure on the part of the serratus posterior superior muscle 42 overlapping the scapula SC. This makes it possible to reliably achieve both the avoidance of pressure on the whole serratus posterior superior muscles 42 including the part of the serratus posterior superior muscle 42 overlapping the scapula SC and the facilitation of upward rotation of the scapulae SC in the supine position.

In other words, in the above configuration, the leg side supporting sections 21 in the scapula supporting sections 20 each support a region corresponding to the part SC1 of the scapula SC at a level equal to or higher than the reference surface 100, wherein the part SC1 of the scapula SC is nearer to the leg side X2 than the serratus posterior superior muscle 42. Thus, the scapulae SC are supported without pressure on the whole serratus posterior superior muscles 42. At the same time, the serratus posterior superior step areas 119, which are lower than the reference surface 100, ensure that the body pressure on a region corresponding to the serratus posterior superior muscle 42 is relatively lower than the body pressure from the reference surface 100. This makes it possible to avoid pressure on the whole serratus posterior superior muscles 42. This enables the whole serratus posterior superior muscles 42 to smoothly pull up the rib group forming the rib cage during breathing in without being hindered by repulsive force of the mattress 1. This facilitates breathing-in motion. Moreover, the leg side supporting section 21 is higher than a portion of the scapula supporting section 20 located nearer to the head side X1 than the leg side supporting section 21. This facilitates upward rotation of the scapula SC in the supine position and also makes it easier to move clavicles and the rib cage to the head side, and thus breathing-in motion is further facilitated in the supine position.

In terms of lasting effect on upward rotation, it is most preferable to have both the levator scapula pressing part 24 and the leg side supporting section 21 that each act as a fulcrum for upward rotation of the scapula SC. However, having only either one produces a satisfactory effect.

In the configuration including the levator scapula pressing part 24 and the leg side supporting section 21 as in the modification (C), the levator scapula pressing part 24 and the leg side supporting section 21 each act as a fulcrum and facilitate upward rotation of the scapula SC. Thus, the configuration provides upward rotation even if the head side step areas 22 are omitted. However, the scapula supporting section including not only the levator scapula pressing part 24 and the leg side supporting section 21 but also the head side step area 22, as in the present embodiment, is able to facilitate upward rotation of the scapula SC in a greatest degree.

(D)

In the modification (C) described above, the head side corresponding part 25 located nearer to the head side X1 than the leg side supporting section 21 in the scapula supporting section 20 is flush with the reference surface 100 in FIG. 1, and the leg side supporting section 21 is higher than the head side corresponding part 25. A configuration in which the leg side supporting section 21 is relatively higher than the head side corresponding part 25 makes it possible to achieve both the avoidance of pressure on the whole serratus posterior superior muscles 42 including the part of the serratus posterior superior muscle 42 overlapping the scapula SC and the facilitation of upward rotation of the scapulae SC in the supine position.

Figure 10:
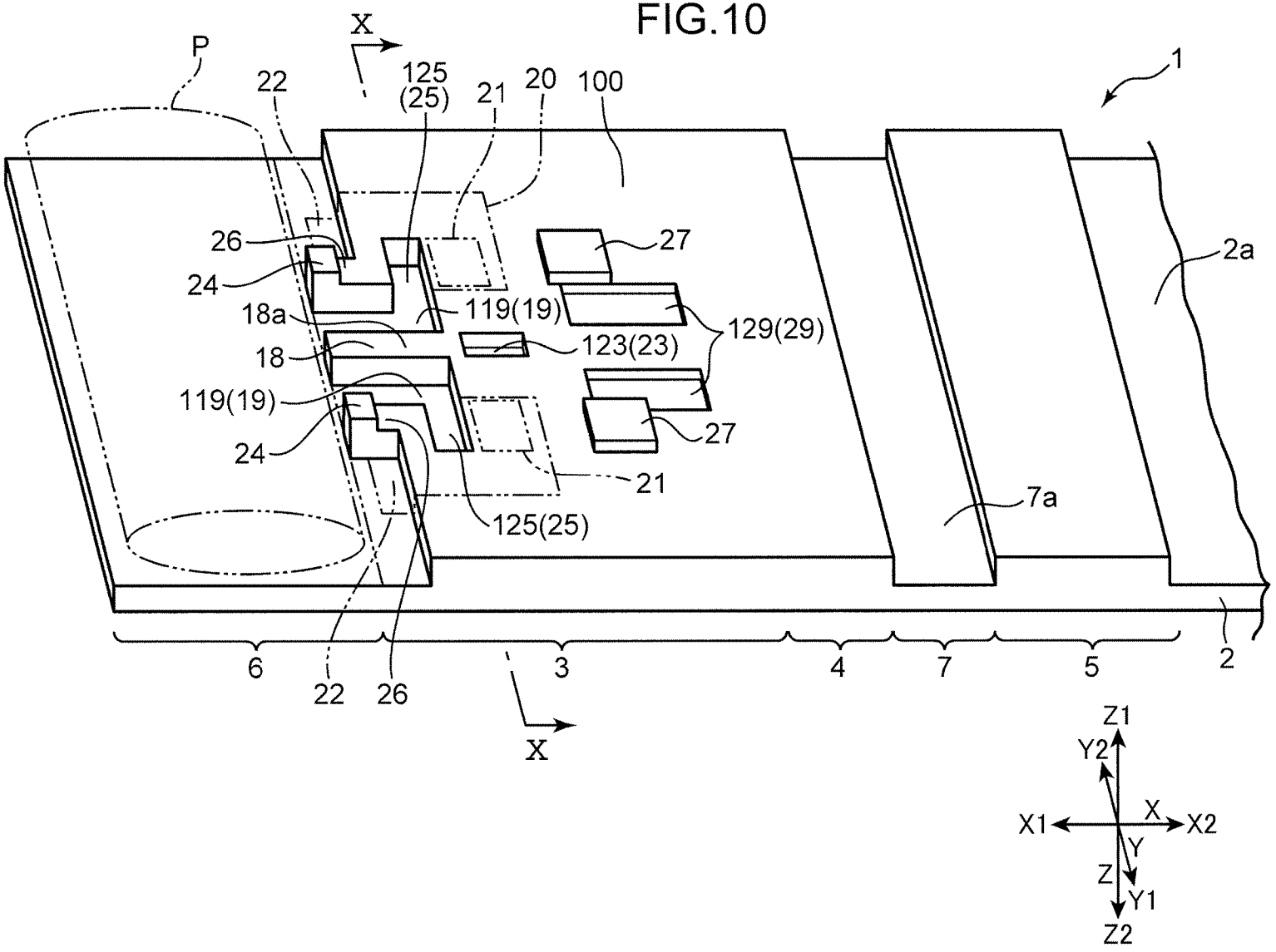
FIG. 10 is a perspective view showing an overall configuration of a mattress according to another modification of the present invention.
Figure 11:
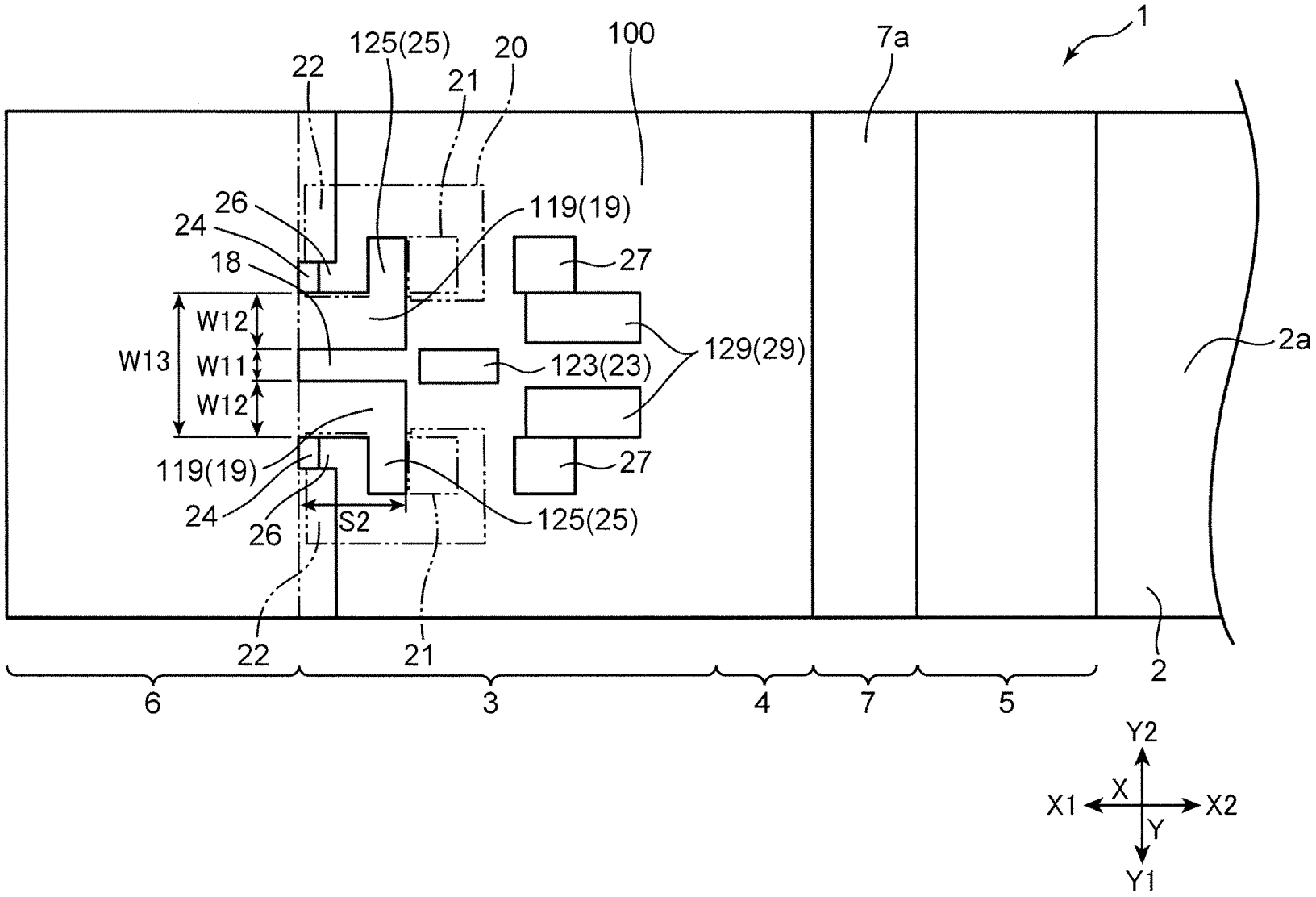
FIG. 11 is a plan view of the mattress in FIG. 10.
Figure 12:
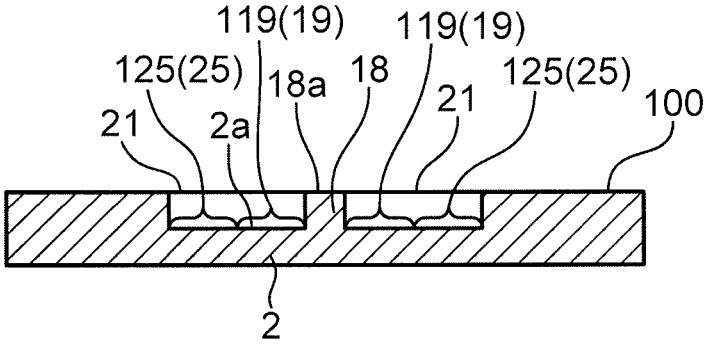
FIG. 12 is a cross-sectional view of the mattress taken along line X-X in FIG. 10.

For instance, in another modification of the present invention, as shown in FIGS. 10 to 12, the head side corresponding part 25 in the scapula supporting section 20 may include a fifth step area 125 that is located below a part of the scapula SC overlapping the serratus posterior superior muscle 42 and that is depressed farther than the reference surface 100. Other components of a mattress shown in FIGS. 10 to 12 are shared with the mattress of the above embodiment shown in FIGS. 1 to 7.

In the configuration of the modification shown in FIGS. 10 to 12, the fifth step area 125 helps to avoid pressure on the whole serratus posterior superior muscles 42 including the part of the serratus posterior superior muscle 42 overlapping the scapula SC, and at the same time, the leg side supporting section 21 is designed to support a portion on the leg side of the scapula SC and facilitate upward rotation of the scapulae SC.

In the modification sown in FIGS. 10 to 12, the fifth step area 125 may be contiguous to the head side step area 22 (the third step area) in the embodiment described above. In this case, the fifth step area 125 and the head side step area 22 are included in one large step area. Thus, the one step area makes it possible to avoid pressure on both the whole serratus posterior superior muscle and the scapular spine and facilitate upward rotation of the scapulae SC.

(E)

The mattress 1 of the embodiment described above includes the thoracic vertebra supporting section 18 between the pair of the serratus posterior superior step areas 119. However, the present invention should not be limited to this. If an area of the pair of the serratus posterior superior step areas 119 is relatively small, the thoracic vertebra supporting section 18 may not exit and the pair of the serratus posterior superior step areas 119 may be linked together. In other words, the pair of the serratus posterior superior step areas 119 may lie across a region corresponding to the spine SP at the back of the human in the supine position and may be contiguous to each other.

According to this configuration, the pair of the serratus posterior superior step areas 119 lie across a region corresponding to the spine SP and are contiguous to each other, thus making it possible to avoid pressure on the spine SP. This gets rid of a sense of pressure on the spine SP and thereby facilitates breathing.

(F)

In the embodiment described above, the serratus posterior superior step areas 119 are each formed in a zone that is located between the spine SP and the scapula SC, and the part of the serratus posterior superior muscle 42 overlapping the scapula SC (see the parts 42*b*1, 42*c*1, and 42*d*1 in FIG. 7) is supported by the scapula supporting section 20. However, the present invention should not be limited to this. In the present invention, the serratus posterior superior step area may be disposed below a region corresponding to at least a middle part between origin and insertion of a region corresponding to the serratus posterior superior muscle 42. Hence, in a modification of the present invention, the serratus posterior superior step area 119 may be formed in a zone that covers a whole of the serratus posterior superior muscle 42 including the part of the serratus posterior superior muscle overlapping the scapula SC (see the parts 42*b*1, 42*cl*, and 42*d*1 in FIG. 7).

Further, in the embodiment described above, the serratus posterior superior step area 119 that has a substantially rectangular shape is disclosed. However, in the present invention, a shape of the serratus posterior superior step area 119 is not particularly limited. Thus, in consideration of the shape of an area covered by the serratus posterior superior muscle 42 being substantially a parallelogram, the serratus posterior superior step area 119 may have a shape of substantially a parallelogram in response to the shape of the area covered by the serratus posterior superior muscle 42.

<Summary of Embodiments>

The embodiments are summarized as follows.

A mattress according to the embodiment described above includes a back supporting section that has a reference surface to support a back of a human in a supine position. The back supporting section includes: a pair of serratus posterior superior corresponding parts that are each disposed below a region corresponding to at least a middle part between origin and insertion of each of a pair of left and right serratus posterior superior muscles of the human in the supine position; a pair of scapula supporting sections disposed outside the pair of the serratus posterior superior corresponding parts in a width direction of a body of the human to support regions corresponding to a pair of left and right scapulae of the human in the supine position; and a sixth thoracic vertebra corresponding part disposed below a region corresponding to an area of two or more consecutive thoracic vertebrae including at least a sixth thoracic vertebra of a spine at the back of the human in the supine position. The serratus posterior superior corresponding parts and the scapula supporting sections are configured such that body pressure from the serratus posterior superior corresponding parts is lower than body pressure from the scapula supporting sections. The sixth thoracic vertebra corresponding part is configured such that body pressure from the sixth thoracic vertebra corresponding part is lower than body pressure from a portion of the back supporting section supporting the spine other than the sixth thoracic vertebra corresponding part.

In this configuration, the back supporting section includes the serratus posterior superior corresponding parts located below the serratus posterior superior muscles, and the scapula supporting sections. The serratus posterior superior corresponding parts and the scapula supporting sections are configured such that the body pressure from the serratus posterior superior corresponding parts is lower than the body pressure from the scapula supporting sections. This makes it possible to avoid pressure on the serratus posterior superior muscle, particularly the middle part of the serratus posterior superior muscle that actively moves, in the supine position. Consequently, breathing-in motion is facilitated in the supine position.

In the mattress described above, the back supporting section includes the sixth thoracic vertebra corresponding part disposed below a region corresponding to the area of two or more consecutive thoracic vertebrae including at least the sixth thoracic vertebra of the spine at the back of the human in the supine position. The sixth thoracic vertebra corresponding part is configured such that body pressure from the sixth thoracic vertebra corresponding part is lower than body pressure from a portion of the back supporting section supporting the spine other than the sixth thoracic vertebra corresponding part.

In this configuration, the body pressure from the sixth thoracic vertebra corresponding part is lower than the body pressure from the portion of the back supporting section supporting the spine other than the sixth thoracic vertebra corresponding part. This helps to avoid pressure on a neighborhood of the sixth thoracic vertebra and further facilitate breathing in the supine position.

In other words, a structure like the mattress of the present embodiment in which the pair of the serratus posterior superior corresponding parts are disposed at both sides of a portion supporting the spine causes body pressure on the spine, particularly on the neighborhood of the sixth thoracic vertebra, to increase compared with the conventional mattress without a pair of serratus posterior superior corresponding parts. However, the mattress with the sixth thoracic vertebra corresponding part as described above makes it possible to partly decrease the body pressure on the neighborhood of the sixth thoracic vertebra. Therefore, the mattress of the present embodiment produces a synergy effect by an effect of the pair of the serratus posterior superior corresponding parts on avoidance of pressure on the serratus posterior superior muscles and an effect of the sixth thoracic vertebra corresponding part on avoidance of pressure on the neighborhood of the sixth thoracic vertebra. This further facilitates breathing in the supine position and makes it possible to have a sleep with improved comfortableness.

Preferably, in the mattress described above, the scapula supporting sections are each at a level flush with or higher than the reference surface, and the serratus posterior superior corresponding parts each include a first step area depressed farther than the reference surface such that the body pressure from the serratus posterior superior corresponding parts is lower than the body pressure from the scapula supporting sections. In this configuration, the first step area helps to reliably avoid pressure on the serratus posterior superior muscles.

Preferably, in the mattress described above, the serratus posterior superior corresponding parts and the scapula supporting sections are set at a level flush with the reference surface, and the serratus posterior superior corresponding parts are made of a material of a degree of hardness lower than a degree of hardness of the scapula supporting sections such that the body pressure from the serratus posterior superior corresponding parts is lower than the body pressure from the scapula supporting sections.

In this configuration, the serratus posterior superior corresponding parts and the scapula supporting sections are at a level flush with the reference surface, which constitutes an upper surface of the back supporting section. This makes it possible to reduce unevenness of the upper surface of the back supporting section and lighten an uncomfortable feeling in the supine position. At the same time, since the degree of hardness of the serratus posterior superior corresponding parts is lower than the degree of hardness of the scapula supporting sections, it is possible to avoid pressure on the serratus posterior superior muscles.

Preferably, in the mattress described above, the sixth thoracic vertebra corresponding part includes a second step area that is depressed farther than the reference surface.

In this simple configuration, the second step area helps to avoid pressure on the neighborhood of the sixth thoracic vertebra and further facilitate breathing in the supine position.

Preferably, in the mattress described above, the scapula supporting sections each further include a third step area that is disposed below a region corresponding to at least a part of a scapular spine at an end on a head side of each of the left and right scapulae, the third step area being depressed farther than the reference surface.

In this configuration, the third step area helps to avoid pressure on the scapular spine at an end on the head side of each of the left and right scapulae and facilitate smoother upward rotation of the scapulae. This also makes it easier to move clavicles and the rib cage to the head side, and thus breathing-in motion is further facilitated in the supine position.

Preferably, in the mattress described above, the back supporting section further includes a pair of serratus posterior inferior corresponding parts that are each disposed below a region corresponding to at least a middle part between origin and insertion of each of a pair of left and right serratus posterior inferior muscles of the human in the supine position, and the serratus posterior inferior corresponding parts are configured such that body pressure from the serratus posterior inferior corresponding parts is lower than body pressure from a portion of the back supporting section other than the serratus posterior inferior corresponding parts.

This configuration makes it possible to avoid pressure on the serratus posterior inferior muscle, particularly the middle part of the serratus posterior inferior muscle that actively moves, in the supine position. Consequently, breathing-out motion is facilitated in the supine position.

Preferably, in the mattress described above, the serratus posterior inferior corresponding parts each include a fourth step area depressed farther than the reference surface.

According to this configuration, the serratus posterior inferior corresponding parts each include the fourth step area depressed farther than the reference surface such that body pressure from the serratus posterior inferior corresponding parts is lower than body pressure from a portion of the back supporting section other than the serratus posterior inferior corresponding parts. As a result, with the serratus posterior inferior step areas, it is possible to reliably avoid pressure on the serratus posterior inferior muscles.

Preferably, in the mattress described above, the back supporting section further includes a pair of rib pressing parts that are disposed outside the pair of the serratus posterior inferior corresponding parts in the width direction of the body of the human and that are located below regions corresponding to pairs of at least eighth ribs and ninth ribs of the human in the supine position, the pair of the rib pressing parts protruding upward beyond the reference surface and being configured to press ribs including the eighth ribs and the ninth ribs from below.

According to this configuration, the rib pressing parts press ribs including the eighth ribs and the ninth ribs from below. This helps the lower portion of the rib cage to open toward the head side and the thoracic vertebrae to slightly bend into an almost ideal state, facilitating breathing-in motion.

Preferably, in the mattress described above, the back supporting section further includes a levator scapula pressing part that is located outside a middle place of a levator scapula muscle of the human in the supine position in the width direction of the body of the human and that is disposed at a place where the levator scapula muscle is allowed to be pressed from outside to inside in the width direction of the body of the human.

In this configuration, the levator scapula pressing part presses the levator scapula muscle from outside to inside and thereby facilitates upward rotation of the scapula in the supine position.

Preferably, in the mattress described above, the levator scapula pressing part protrudes upward beyond the reference surface and is configured to press the levator scapula muscle at a place higher than the reference surface from outside to inside in the width direction of the body of the human.

In this configuration, the levator scapula pressing part presses the levator scapula muscle at a place higher than the reference surface from outside to inside and thereby further facilitates upward rotation of the scapula in the supine position.

Preferably, in the mattress described above, the pair of the scapula supporting sections each include a leg side supporting section to support a region corresponding to a part of each of the left and right scapulae nearer to a leg side than each of the left and right serratus posterior superior muscles at a level equal to or higher than the reference surface; and a head side corresponding part located nearer to a head side than the leg side supporting section, wherein the leg side supporting section is relatively higher than the head side corresponding part.

According to this configuration, in the scapula supporting sections, the leg side supporting section is relatively higher than the head side corresponding part located nearer to the head side than the leg side supporting section. This makes it possible to achieve both the avoidance of pressure on the whole serratus posterior superior muscles including the part of the serratus posterior superior muscle overlapping the scapula and the facilitation of upward rotation of the scapulae in the supine position, and thus breathing-in motion is facilitated in the supine position.

Preferably, in the mattress described above, the leg side supporting section protrudes upward beyond the reference surface and is configured to support a region corresponding to the part of each of the left and right scapulae nearer to the leg side than each of the left and right serratus posterior superior muscles at a level higher than the reference surface.

In this configuration, the leg side supporting section supports the leg side part of each of the left and right scapulae at a level higher than the reference surface. This makes it possible to reliably achieve both the avoidance of pressure on the whole serratus posterior superior muscles including the part of the serratus posterior superior muscle overlapping the scapula and the facilitation of upward rotation of the scapulae.

Preferably, in the mattress described above, the head side corresponding part includes a fifth step area that is located below a part of each of the left and right scapulae overlapping each of the left and right serratus posterior superior muscles, the fifth step area being depressed farther than the reference surface.

In this configuration, the fifth step area helps to avoid pressure on the whole serratus posterior superior muscles including the part of the serratus posterior superior muscle overlapping the scapula, and at the same time, the leg side supporting section is designed to support a portion on the leg side of the scapula and facilitate upward rotation of the scapulae.

The mattress of the present embodiment configured as described above is designed to make it possible to facilitate breathing in the supine position.

The invention claimed is:

1. A mattress comprising a back supporting section that has a reference surface configured to support a back of a human user in a supine position, the back supporting section comprising:

a pair of serratus posterior superior corresponding parts that are each configured to be disposed below a region corresponding to at least a middle part between origin and insertion of each of a pair of left and right serratus posterior superior muscles of the user in the supine position;

a pair of scapula supporting sections disposed outside the pair of the serratus posterior superior corresponding parts in a width direction of a body of the user and configured to support regions corresponding to a pair of left and right scapulae of the user in the supine position; and a sixth thoracic vertebra corresponding part configured to be disposed below a region corresponding to an area of two or more consecutive thoracic vertebrae including at least a sixth thoracic vertebra of a spine at the back of the user in the supine position, wherein the serratus posterior superior corresponding parts and the scapula supporting sections are configured such that a body pressure of the user on the serratus posterior superior corresponding parts is lower than a body pressure of the user on the scapula supporting sections, the pair of the serratus posterior superior corresponding parts are disposed on respective opposite sides of a spine supporting portion configured to support the spine of the user, the pair of the serratus posterior superior corresponding parts and the sixth thoracic vertebra corresponding part are arranged in a fixed disposition so that a body pressure of the user on the sixth thoracic vertebra corresponding part is lower than a body pressure of the user on the spine supporting portion, the spine supporting portion being a portion other than the sixth thoracic vertebra corresponding part, and an entirety of the back supporting portion is formed as one body.

2. The mattress according to claim 1, wherein the scapula supporting sections are each at a level flush with or higher than the reference surface, and the serratus posterior superior corresponding parts each comprise a first step area depressed farther than the reference surface such that the body pressure on the serratus posterior superior corresponding parts of the mattress is lower than the body pressure on the scapula supporting sections of the mattress.

3. The mattress according to claim 2, wherein the scapula supporting sections each further comprise a second step area that is configured to be disposed below a region corresponding to at least a part of a scapular spine of the user at an end on a head side of a respective one of the left and right scapulae of the user, the second step area being depressed farther than the reference surface.

4. The mattress according to claim 2, wherein the back supporting section further comprises a pair of serratus posterior inferior corresponding parts that are each configured to be disposed below a region corresponding to at least a middle part between origin and insertion of a respective one of a pair of left and right serratus posterior inferior muscles of the user in the supine position, and the serratus posterior inferior corresponding parts are configured such that a body pressure of the user on the serratus posterior inferior corresponding parts is lower than a body pressure of the user on a portion of the back supporting section other than the serratus posterior inferior corresponding parts.

5. The mattress according to claim 2, wherein the back supporting section further comprises a levator scapula pressing part that is configured to be located outside a middle place of a levator scapula muscle of the user in the supine position in the width direction of the body of the user, and that is configured to be disposed at a place where the levator scapula muscle is allowed to be pressed from outside to inside in the width direction of the body of the user.

6. The mattress according to claim 1, wherein the back supporting section further comprises a pair of serratus posterior inferior corresponding parts that are each configured to be disposed below a region corresponding to at least a middle part between origin and insertion of a respective one of a pair of left and right serratus posterior inferior muscles of the user in the supine position, and the serratus posterior inferior corresponding parts are configured such that a body pressure of the user on the serratus posterior inferior corresponding parts is lower than a body pressure of the user on a portion of the back supporting section other than the serratus posterior inferior corresponding parts.

7. The mattress according to claim 6, wherein the serratus posterior inferior corresponding parts each comprise a step area depressed farther than the reference surface.

8. The mattress according to claim 6, wherein the back supporting section further comprises a pair of rib pressing parts that are configured to be disposed outside the pair of the serratus posterior inferior corresponding parts in the width direction of the body of the user and that are configured to be located below regions corresponding to pairs of at least eighth ribs and ninth ribs of the user in the supine position, the pair of the rib pressing parts protruding upward beyond the reference surface and being configured to press ribs including the eighth ribs and the ninth ribs of the user from below.

9. The mattress according to claim 1, wherein the back supporting section further comprises a levator scapula pressing part that is configured to be located outside a middle place of a levator scapula muscle of the user in the supine position in the width direction of the body of the user, and that is configured to be disposed at a place where the levator scapula muscle is allowed to be pressed from outside to inside in the width direction of the body of the user.

10. The mattress according to claim 9, wherein the levator scapula pressing part protrudes upward beyond the reference surface and is configured to press the levator scapula muscle at a place higher than the reference surface from outside to inside in the width direction of the body of the user.

11. The mattress according to claim 1, wherein one of the pair of the scapula supporting sections comprises:

a first leg side supporting section configured to support a region corresponding to a part of the left scapula of the user nearer to a leg side of the user than the left serratus posterior superior muscle of the user at a level equal to or higher than the reference surface; and a first head side corresponding part configured to be located nearer to a head side of the user than the first leg side supporting section, wherein the other of the pair of the scapula supporting sections comprises:

a second leg side supporting section configured to support a region corresponding to a par of the right scapula of the user nearer to the leg side of the user than the right serratus posterior superior muscle of the user at a level equal to or higher than the reference surface; and a second head side corresponding part configured to be located nearer to the head side of the user than the second leg side supporting section, wherein the first leg side supporting section is relatively higher than the first head side corresponding part, and the second leg side supporting section is relatively higher than the second head side corresponding part.

12. The mattress according to claim 11, wherein the first leg side supporting section protrudes upward beyond the reference surface and is configured to support the region corresponding to the part of the left scapula of the user nearer to the leg side of the user than the left serratus posterior superior muscle of the user at a level higher than the reference surface, and the second leg side supporting section protrudes upward beyond the reference surface and is configured to support the region corresponding to the part of the right scapula of the user nearer to the leg side of the user than the right serratus posterior superior muscle of the user at a level higher than the reference surface.

13. The mattress according to claim 11, wherein the first head side corresponding part comprises a step area that is depressed farther than the reference surface, and that is configured to be located below a part of the left scapula of the user overlapping the left serratus posterior superior muscle of the user, and the second head side corresponding part comprises a step area that is depressed farther than the reference surface, and that is configured to be located below a part of the right scapula of the user overlapping the right serratus posterior muscle of the user.

14. The mattress according to claim 1, wherein the sixth thoracic vertebra corresponding part comprises a first step area that is depressed farther than the reference surface.

15. The mattress according to claim 14, wherein the scapula supporting sections each further comprise a second step area that is configured to be disposed below a region corresponding to at least a part of a scapular spine of the user at an end on a head side of a respective one of the left and right scapulae of the user, the second step area being depressed farther than the reference surface.

16. The mattress according to claim 14, wherein the back supporting section further comprises a levator scapula pressing part that is configured to be located outside a middle place of a levator scapula muscle of the user in the supine position in the width direction of the body of the user, and that is configured to be disposed at a place where the levator scapula muscle is allowed to be pressed from outside to inside in the width direction of the body of the user.

17. The mattress according to claim 14, wherein the back supporting section further comprises a pair of serratus posterior inferior corresponding parts that are each configured to be disposed below a region corresponding to at least a middle part between origin and insertion of a respective one of a pair of left and right serratus posterior inferior muscles of the user in the supine position, and the serratus posterior inferior corresponding parts are configured such that a body pressure of the user on the serratus posterior inferior corresponding parts is lower than a body pressure of the user on a portion of the back supporting section other than the serratus posterior inferior corresponding parts.

18. The mattress according to claim 1, wherein the serratus posterior superior corresponding parts and the scapula supporting sections are set at a level flush with the reference surface, and the serratus posterior superior corresponding parts are made of a material of a degree of hardness lower than a degree of hardness of the scapula supporting sections such that the body pressure on the serratus posterior superior corresponding parts of the mattress is lower than the body pressure on the scapula supporting sections of the mattress.

19. The mattress according to claim 1, wherein the scapula supporting sections each further comprise a step area that is configured to be disposed below a region corresponding to at least a part of a scapular spine of the user at an end on a head side of a respective one of the left and right scapulae of the user, the step area being depressed farther than the reference surface.

* * * * *